US008316937B2

(12) United States Patent
Cronley et al.

(10) Patent No.: US 8,316,937 B2
(45) Date of Patent: Nov. 27, 2012

(54) MULTI-WINDOW LATERAL WELL LOCATOR/REENTRY APPARATUS AND METHOD

(75) Inventors: Gerald J. Cronley, Gretna, LA (US); Timothy T. Torrez, Aztec, NM (US)

(73) Assignee: Knight Information Systems, LLC, Lafayette, LA (US)

( * ) Notice: Subject to any disclaimer, the term of this patent is extended or adjusted under 35 U.S.C. 154(b) by 414 days.

(21) Appl. No.: 12/796,965

(22) Filed: Jun. 9, 2010

(65) Prior Publication Data

US 2010/0252257 A1 Oct. 7, 2010

Related U.S. Application Data

(63) Continuation-in-part of application No. 12/417,170, filed on Apr. 2, 2009, now Pat. No. 8,069,920.

(51) Int. Cl.
*E21B 47/09* (2012.01)

(52) U.S. Cl. ..... 166/255.1; 166/117.5

(58) Field of Classification Search ..... 166/255.1, 166/255.2, 255.3, 117.5, 117.6, 50
See application file for complete search history.

(56) References Cited

U.S. PATENT DOCUMENTS 4,103,740 A * 8/1978 Yonker ..... 166/117.5
5,311,936 A 5/1994 McNair et al.
5,458,209 A 10/1995 Hayes et al.
6,244,340 B1 6/2001 McGlothen et al.
6,315,054 B1 11/2001 Brunet
6,334,485 B1 1/2002 George
7,448,446 B2 11/2008 Campbell et al.
7,455,110 B2 11/2008 Lynde
7,980,307 B2 * 7/2011 Saylor, III ..... 166/255.2
2002/0100588 A1 8/2002 Murray et al.
2003/0150612 A1 8/2003 McGarian et al.

OTHER PUBLICATIONS

Search Report, Aug. 11, 2011, Cronely et al., PCT/US11/035833.
Written Opinion, Aug. 11, 2011, Cronely et al., PCT/US11/035833.
U.S. Appl. No. 12/417,170, Cronley et al.

* cited by examiner

*Primary Examiner* — Giovanna Wright
*Assistant Examiner* — Blake Michener
(74) *Attorney, Agent, or Firm* — Jones Walker

(57) ABSTRACT

A down-hole assembly used to locate an existing window in a main cased well bore and guide equipment through the window and into a lateral well bore after removal of a whip stock. The down-hole assembly includes a running tool with a convex section detachably connected to a concave section of a guide member. The running tool includes a window locator that locates the window. The window locator may contain a selectively reciprocating shear rod operatively associated with a stop/shear block to enable the window locator to locate a plurality of lateral well windows in a main well bore. The guide member includes an inclined or wedge shaped portion for guiding tools or equipment through the window and into the lateral well bore so that remedial work can be carried out.

41 Claims, 19 Drawing Sheets

MULTI-WINDOW LATERAL WELL LOCATOR/REENTRY APPARATUS AND METHOD

CROSS-REFERENCE TO RELATED APPLICATIONS

This application is a continuation-in-part of and claims priority to U.S. patent application Ser. No. 12/417,170, filed Apr. 2, 2009, which is incorporated herein by reference.

FIELD OF THE INVENTION

The present invention relates to a multi-window lateral well locating/reentry apparatus and method, and more particularly to an apparatus and method for locating multiple windows in a main well and reinstalling a guide for reentry through the windows and into lateral wells.

BACKGROUND OF THE INVENTION

In the exploration for oil and gas, a main well bore is drilled and cased. The well bore may be a vertical or horizontal well. It is often necessary to drill one or more lateral wells off of the main well bore. These lateral wells are usually drilled to increase production from the producing zone or enter new zones which may contain a hydrocarbon reservoir. To drill a lateral well, a whip stock is run into the main well bore on a work string and anchored at a location where the lateral well is to be drilled. The upper end of the whip stock has an inclined face. A milling bit on a tubular is diverted by the whip stock's inclined face into the casing wall where a window or opening in the casing is made for a lateral exit from the main well bore. The whip stock may be removed from the well bore after the lateral has been completed.

After removal of the whip stock, the need may arise to reenter a lateral well to clean it out or conduct remedial work. The present invention provides a reliable, cost-effective means to locate and reenter a lateral well bore after the whip stock has been removed from the main well bore.

The need may also arise to reenter multiple lateral wells from a single main well to clean such lateral wells or conduct remedial work therein. The present invention provides a reliable, cost-effective means to locate and reenter multiple lateral well bores after the whip stock has been removed from the main well bore.

SUMMARY OF THE INVENTION

It is an object of the present invention to provide a down-hole assembly and method capable of locating a window in a well bore.

It is a further object of the present invention to provide a down-hole assembly and method capable of determining the dimension and shape of a window in a well bore.

It is a further object of the present invention to provide a down-hole assembly and method capable of reinstalling a guide for reentry through a window into a lateral well bore.

It is a further object of the present invention to provide a down-hole assembly and method capable of the combined procedure of locating a window and guiding reentry of a down-hole tool through the window into a lateral well bore after a whip stock has been removed.

It is an object of the present invention to provide a down-hole assembly and method capable of locating multiple windows in a well bore.

It is a further object of the present invention to provide a down-hole assembly and method capable of determining the dimension and shape of multiple windows in a well bore.

It is a further object of the present invention to provide a down-hole assembly and method capable of reinstalling a guide for reentry through multiple lateral-well-bore windows.

It is a further object of the present invention to provide a down-hole assembly and method capable of the combined procedure of locating multiple lateral-well-bore windows and guiding reentry of a down-hole tool through each of the windows into a lateral well bore after a whip stock has been removed.

These and other objects and advantages of the present invention are achieved by a novel down-hole assembly for locating a window and reentering a lateral well bore in a main well bore after removal of a whip stock. The down-hole assembly may include a running tool having an upper section, a middle section and a lower section. The running tool may include a window locator for locating the window in the main well bore which leads to the lateral well bore. The assembly may also include a guide member having an upper section, a middle section and a lower section. The guide member may have a wedged-shaped outer surface for diverting a down-hole tool through the window and into the lateral well bore. The lower section of the running tool and the upper section of the guide member may each be shaped to receive the other in mating relationship. The lower section of the running tool and the upper section of the guide member may be capable of being detachably connected. When detachably connected, the running tool and the guide member may be in fluid communication.

The window locator in the running tool may include a pivoting arm and a window locating head. The running tool may also have biasing means operatively associated with the window locator. The biasing means may exert a force on the pivoting arm of the window locator to bias the window locating head in a direction external of the running tool. The window locating head may have a run-in position, a retracted position, and a window locating position. In the run-in position, the window locating head is positioned between the retracted and window locating positions and held stationary. The running tool may include one or more shear pins affixed to the window locator. The shear pins maintain the window locating head in the stationary position until sheared. In the retracted position, the window locating head is positioned substantially within the running tool. The window locating head may be held in the retracted position by the main well bore. In the window locating position, the window locating head may be biased in a direction external of the running tool with a portion of the window locating head positioned within the window.

The running tool may include a block means for restricting a maximum outward pivoting angle of the window locating head. The block means may have a shoulder capable of receiving an outer edge surface of the window locating head.

The running tool may include a stop means for preventing retraction of the window locating head from the window locating position. The stop means may comprise one or more spring-loaded shear pins. The one or more spring loaded shear pins may be actuated by displacement of the window locating head from the retracted position to the window locating position and deactivated by a shearing force. The deactivation may result in the window locating head returning to the retracted position.

The upper section of the running tool may have a first internal fluid passage bore and the lower section of the running tool may have a second internal fluid passage bore. The first and second internal fluid passage bores may be fluidly connected by a conduit. The conduit may by-pass the window locator.

The shape of the lower end of the running tool (or a portion thereof) may be substantially convex. The shape of the upper end of the guide member (or a portion thereof) may be substantially concave. The lower section of the running tool and the upper section of the guide member may be detachably connected by a shear bolt. The lower section of the running tool and the upper end of the guide member may be further detachably connected by a dovetail joint.

The guide member may include an internal fluid passage bore. The running tool may include a stinger pipe fluidly connected to the second internal fluid passage bore. The stinger pipe may be sealingly connected to the internal fluid passage bore of the guide member when the running tool and the guide member are detachably connected.

The guide member may also include a retrieval means. The retrieval means may provide a point of operative attachment for a retrieval or fishing tool for retrieval of the guide member.

In an alternative embodiment, the down-hole assembly may include a diverter sub having an upper end and a lower end. The upper end of the diverter sub may be operatively connected to a tubular. The assembly may also include a running tool having an upper section, a middle section and a lower section. The upper section of the running tool may be operatively connected to the lower end of the diverter sub. The running tool may have a window locator for locating a window in a main cased well bore. The upper section of the running tool may include a first internal fluid passage bore. The lower section of the running tool may include a second internal fluid passage bore. The running tool may also have a conduit fluidly connecting the first and second internal fluid passage bores. The assembly may also include a guide member having an upper section, a middle section and a lower section. The lower section of the running tool and the upper section of the guide member may each be shaped to receive the other in mating relationship. The guide member may have an internal fluid passage bore. The upper section of the guide member may be detachably connected to the lower section of the running tool. The guide member may have a wedged-shaped outer surface for diverting a down-hole tool through the window and into the lateral well bore. The assembly may also have a stinger pipe with an upper end and a lower end. The upper end of the stinger pipe may be sealingly connected to the second internal fluid passage bore in the lower end of the running tool. The lower end of the stinger pipe may be sealingly connected to the internal fluid passage bore of the guide member. The assembly may also include a debris sub having an upper end and a lower end. The upper end of the debris sub may be operatively connected to the lower section of the guide member. The debris sub may include an internal fluid passage bore in fluid communication with the internal fluid passage bore of the guide member. The assembly may also include an anchor sub having an upper end and a lower end. The upper end of the anchor sub may be operatively connected to the lower end of the debris sub. The anchor sub may include an internal fluid passage bore fluidly connected to the internal fluid passage bore of the debris sub. The anchor sub may have anchor means for detachably affixing the anchor sub to the main cased well bore.

The tubular may be a work string, drill pipe or coiled tubing. If the tubular is coiled tubing, the down-hole assembly may further comprise an indexing tool.

In the alternative embodiment, the window locator may comprise a pivoting arm and a window locating head. The running tool may include a biasing means operatively associated with the window locator. The biasing means may exert a force on the pivoting arm of the window locator to bias the window locating head in a direction external of the running tool. The window locating head may have a run-in position, a retracted position, and a window locating position. In the run-in position, the window locating head may be positioned between the retracted and the window locating positions and held stationary. In the run-in position, the window locating head may be partially positioned external of the running tool for engagement with the main cased well bore or a smaller internal diameter section of the main cased well bore.

In the alternative embodiment, the shape of the lower end of the running tool (or a portion thereof) may be convex. The shape of the upper end of the guide member (or a portion thereof) may be concave. The lower section of the running tool and the upper section of the guide member may be detachably connected by a shear bolt. The lower section of the running tool and the upper end of the guide member may be further detachably connected by a dovetail joint. The running tool may include one or more shear pins affixed to the window locator. The shear pins maintain the window locating head in the stationary position until sheared. In the retracted position, the window locating head is positioned substantially within the running tool. The window locating head may be held in the retracted position by the main cased well bore or more particularly, the inner wall of the main cased well bore. In the window locating position, the window locating head may be biased in a direction external of the running tool with a portion of the window locating head positioned within the window.

The running tool of the alternative embodiment may also include a block means for restricting a maximum outward pivoting angle of the window locating head. The block means may be L-shaped and have a shoulder capable of receiving an outer edge surface of the window locating head.

The running tool of the alternative embodiment may also include stop means for preventing retraction of the window locating head from the window locating position. The stop means may comprise one or more spring-loaded shear pins. The one or more spring loaded shear pins may be actuated by displacement of the window locating head from the retracted position to the window locating position and deactivated by a shearing force. The deactivation may result in the window locating head returning to the retracted position.

The guide member of the alternative embodiment may include a retrieval means. The retrieval means may provide a point of operative attachment for a fishing tool.

The present invention is also directed to a method of locating a window and reentering a lateral well bore in a main well bore from which a whip stock has been removed. The main well bore may be a cased well. The method may include the step of deploying a tubular down the main well bore. The tubular may be a work string such as drill pipe or coiled tubing. The tubular may contain a down-hole assembly. The down-hole assembly may include a running tool having an upper section, a middle section and a lower section. The running tool may include a window locator for locating the window. The assembly may also have a guide member with an upper section, a middle section and a lower section. The guide member may have a wedged-shaped outer surface for diverting a down-hole tool through the window and into the lateral well bore. The lower section of the running tool and the upper section of the guide member may each be shaped to receive the other in mating relationship. The lower section of the running tool and the upper section of the guide member may be capable of being detachably connected. When detachably connected, the running tool and the guide member are in fluid communication.

The method may also includes the step of activating the window locator so that the window locator is able to reposition to a window locating position external of the running tool when the running tool is placed adjacent the window. The method may further include the step of causing the window locator to reposition to the window locating position by placing the running tool adjacent the window. The method may involve the step of maintaining the window locator in the window locating position. The method may include the steps of determining the dimensions of the window (e.g., determining an upper edge of the window and a lower edge of said window) and positioning the guide member, and more particularly the wedge-shaped portion of the guide member, adjacent the window. The method may further include the step of anchoring the guide member in the main cased well bore. The method may also involve detaching the running tool from the guide member and pulling the running tool out of the main cased well bore. The method may then proceed with the steps of deploying a second tubular containing a down-hole tool down the main cased well bore, through the window, and into the lateral well bore. The wedged-shaped outer surface of the guide member may act to divert the down-hole tool from the main cased well bore, through the window, and into the lateral well bore.

The method of the present involve may further comprise the step of causing the down-hole tool to perform remedial work on the lateral well bore. The method may additionally include the steps of deploying a third tubular containing a fishing tool down the main cased well bore, connecting the fishing tool to the guide member, disengaging the guide member from the main cased well bore, and pulling the guide member out of the main cased well bore.

The down-hole assembly and method of the present invention eliminate the need for running a caliper log to determine the position and shape of the window. Once the down-hole assembly, is set in place about the window, the well is restored to the same configuration that the well had before the whip stock was removed. The down-hole assembly permits drill bits, mill bits, work strings, and even tools with shoulders to be run in and out of the window without fear of dislodging the concave member (i.e., the guide member). The down-hole assembly also allows the window to be reamed out with one or more mills without causing the concave member to drop down-hole. Once work on the lateral well bore is completed, the down-hole assembly may be easily removed from the well bore with a retrieving tool.

The down-hole assembly is a reliable, cost-effective tool to locate and reenter an existing window in a cased well. The down-hole assembly may be used to clean-out a lateral well bore such as a horizontal leg, to restore production. The down-hole assembly may also be used to re-drill a lateral well. It could also be used to install a liner in an existing lateral. The down-hole assembly may be used for any type of remedial work where a reliable guide in and out of an existing window is required.

In an alternative embodiment, the down-hole assembly is capable of locating a plurality of lateral well bore windows in a main well bore. The running tool may have an upper section, a middle section, a lower section and an internal cavity section with a cavity floor. The running tool may include a window locator assembly for locating the plurality of lateral well bore windows. The window locator assembly may be pivotally positioned within the cavity of the running tool and may include a window locator and a stop/shear block. The window locator may include a selectively reciprocating shear rod operatively associated with the stop/shear block. The shear rod may have a proximal end, a distal end, and an outer surface including a plurality of shoulders. The outer surface of the shear rod may also have a plurality of shear grooves. The stop/shear block may include a shear rod engaging surface, a tapered surface, a shear surface, and a stop shoulder. The alternative down-hole assembly may also contain a guide member having an upper section, a middle section and a lower section. The guide member may have a wedged-shaped outer surface for diverting a down-hole tool through one of the plurality of windows and into the lateral well bore for the window. The lower section of the running tool and the upper section of the guide member may each be shaped to receive the other in mating relationship. The lower section of the running tool and the upper section of the guide member may be capable of being detachably connected. When detachably connected, the running tool and the guide member may be in fluid communication.

In the alternative down-hole assembly, the window locator may include a first spring means operatively connected to the shear rod. The first spring means may bias the shear rod in a direction towards the stop/shear block. The first spring means may be operatively connected to the proximal end of the shear rod.

The window locator in the alternative assembly may further include a spring-loaded bushing surrounding a first portion of the shear rod. The spring-loaded bushing may include a second spring means.

The window locator in the alternative assembly may also include a dog assembly having an upper section, a lower section and an internal section containing a dog. The lower section may be positioned external of the window locator. The internal section may be operatively associated with a second portion of the shear rod. The dog may selectively engage a shoulder of the shear rod to prevent the shear rod from being reciprocated in the direction of the stop/shear block by the first spring means. The dog assembly may be movably positioned within a recess in the window locator. The second spring means of the spring-loaded bushing biases the spring-loaded bushing into operative engagement with the dog assembly.

In the alternative assembly, the window locator may further include a floating plate and a plurality of spring means. The floating plate and the plurality of spring means may each be contained within the recess of the window locator. The plurality of spring means may bias the floating plate into operative engagement with the upper section of the dog assembly.

The window locator may also include a shear bushing surrounding a third portion of the shear rod. The shear bushing may be positioned adjacent to the stop/shear block. The stop/shear block may further include an inspection window for viewing the alignment of the shear bushing with the shear grooves on the surface of the shear rod.

The shear rod engaging surface of the stop/shear block may include an adjustable calibration plate. The calibration plate may be used to calibrate the point at which the dog selectively engages one of the shoulders of the shear rod. The running tool may further include a calibration hole directly over the dog such that a user may view the point at which the dog selectively engages one of the shoulders of the shear rod.

The stop/shear block may include a U-shaped catcher for receiving the distal end of the shear rod. The catcher may also retain the distal end of the shear rod or the sheared piece of the shear rod after the distal end is sheared. The catcher may be positioned between the stop shoulder and the shear surface of the stop/shear block. The catcher may include a V-shaped surface capable of allowing the sheared piece of the shear rod to travel in only one direction.

In the alternative assembly, the running tool may have a pocket operatively connected to the stop/shear block for storing the sheared piece or pieces of the shear rod.

In another embodiment of the alternative down-hole assembly, the running tool may have an upper section, a middle section, a lower section, and an internal cavity section with a cavity floor. The running tool may include a window locator assembly for locating the plurality of lateral well bore windows. The window locator assembly may be pivotally positioned within the cavity of the running tool and include a window locator and a stop/shear block. The window locator may comprise a pivoting arm, a window locating head, and a selectively reciprocating shear rod operatively associated with the stop/shear block. The shear rod may have a proximal end, a distal end, and an outer surface including a plurality of shoulders. The outer surface of the shear rod may also include a plurality of shear grooves. The stop/shear block may include a shear rod engaging surface, a tapered surface, a shear surface, and a stop shoulder. The running tool further may include a biasing means operatively associated with the window locator. The biasing means may exert a force on the pivoting arm of the window locator to bias the window locator head in a direction external of the running tool. The assembly may also include a guide member having an upper section, a middle section, and a lower section. The guide member may have a wedge-shaped outer surface for diverting a down-hole tool through one of the plurality of lateral well windows and into the lateral well bore for the window. The lower section of the running tool and the upper section of the guide member may each be shaped to receive the other in mating relationship. The lower section of the running tool and the upper section of the guide member may be capable of being detachably connected. When detachably connected, the running tool and the guide member may be in fluid communication.

In this embodiment, the window locator may include: a first spring means operatively connected to the shear rod, the spring means biasing the shear rod in a direction towards the stop/shear block; a spring-loaded bushing surrounding a first portion of the shear rod, the spring-loaded bushing including a second spring means; a recess in the window locating head; a dog assembly movably positioned within the recess of the window locating head, the dog assembly may have an upper section, a lower section, and an internal section containing a dog, the lower section may be positioned external of the window locator, the internal section may be operatively associated with a second portion of the shear rod, the dog may selectively engage a shoulder of the shear rod to prevent the shear rod from being reciprocated in the direction of the stop/shear block by the first spring means; a floating plate and a plurality of spring means, the floating plate and the plurality of spring means may each be contained within the recess of the window locating head, the plurality of spring means may bias the floating plate into operative engagement with the upper section of the dog assembly; and a shear bushing surrounding a third portion of the shear rod, the shear bushing positioned adjacent to the stop/shear block. The stop/shear block may further include an inspection window for viewing the alignment of the shear bushing with the shear grooves on the surface of the shear rod.

The first spring means may be operatively connected to the proximal end of the shear rod. The second spring means of the spring-loaded bushing may bias the spring-loaded bushing into operative engagement with the dog assembly.

The shear rod engaging surface of the stop/shear block may include an adjustable calibration plate. The calibration plate may be used to calibrate the point at which the dog selectively engages a shoulder of the shear rod. The running tool may further include a calibration hole directly over the dog such that a user may view the point at which the dog selectively engages a shoulder of the shear rod.

The stop/shear block may further include a catcher for receiving the distal end of the sheared rod. The catcher may also retain the distal end of the shear rod or the sheared piece of the shear rod after shearing. The catcher may be positioned between the stop shoulder and the shear surface of the stop/shear block. The catcher may include a V-shaped surface capable of allowing the sheared piece of the shear rod to travel in only one direction.

The running tool may also include a pocket for storing the sheared piece of the shear rod. The pocket may be operatively connected to the stop/shear block for passage of the sheared piece from the catcher to the pocket.

The present invention is also drawn to a method of locating a plurality of lateral well bore windows in a main well bore. The method involves deploying a tubular down the main well bore. The tubular may contain a down-hole assembly. The down-hole assembly may include a running tool having an upper section, a middle section, a lower section, and an internal cavity section with a cavity floor. The running tool may include a window locator assembly for locating the plurality of lateral well bore windows. The window locator assembly may be pivotally positioned within the cavity of the running tool and include a window locator and a stop/shear block. The window locator may include a pivoting arm, a window locating head, and a selectively reciprocating shear rod operatively associated with the stop/shear block. The shear rod may have a proximal end, a first distal end, and an outer surface including a plurality of shoulders. The stop/shear block may include a shear rod engaging surface, a tapered surface, a shear surface, and a stop shoulder. The assembly may have a guide member with an upper section, a middle section, and a lower section. The guide member may have a wedge-shaped outer surface for diverting a down-hole tool through one of the plurality of lateral well bore windows and into the lateral well bore. The lower section of the running tool and the upper section of the guide member may each be shaped to receive the other in mating relationship. The lower section of the running tool and the upper section of the guide member may be capable of being detachably connected. When detachably connected, the running tool and the guide member may be in fluid communication. At deployment, the reciprocating shear rod is maintained in a non-reciprocating position so that the first distal end of the shear rod does not engage the engaging surface of the stop/shear block.

The method also includes the step of running the down-hole assembly to a first area in the main well bore having a first internal diameter that causes the window locating head to move inward relative to the cavity of the running tool releasing the shear rod from the non-reciprocating position to a reciprocating position wherein the first distal end of the shear rod engages the engaging surface of the stop/shear block. The method also includes the step of running the down-hole assembly to a second area in the main well bore having a second internal diameter that causes the window locating head to move further inward relative to the cavity of the running tool. The method then involves running the down-hole assembly to a first lateral well window in the main well bore that causes the window locating head to move outward relative to the cavity of the running tool to a first window locating position wherein the first distal end of the shear rod upwardly traverses the engaging surface of the stop/shear block, the tapered surface of the stop/shear block, and engages the stop shoulder. The method continues with the step of determining an upper edge or a lower edge of the first lateral well bore window. The method then includes the step of positioning the down-hole assembly to a third area in the main well bore having a third internal diameter that causes the window locating head to move inward relative to the cavity of the running tool wherein the first distal end of the shear rod is sheared by the shear surface of the stop/shear block resulting in a second distal end of the shear rod, the second distal end of the shear rod downwardly traverses the tapered surface of the stop/shear block and the engaging surface of the stop/shear block. The method includes the step of running the down-hole assembly to a second lateral well bore window in the main well bore that causes the window locating head to move outward relative to the cavity of the running tool to a second window locating position wherein the second distal end of the shear rod upwardly traverses the engaging surface of the stop/shear block, the tapered surface of the stop/shear block, and engages the stop shoulder. The method includes determining an upper edge or a lower edge of the second lateral well bore window.

If the stop/shear block includes a catcher for receiving the first distal end of the shear rod. The catcher may also retain the sheared first distal end of the shear rod, the method may include the step of retaining the sheared first distal end of the shear rod in the catcher. The catcher may include a V-shaped surface capable of allowing the sheared first distal end of the shear rod to travel in only one direction.

The method may also further comprise the steps of repeating the prior steps one to five additional times to locate a third, fourth, fifth, sixth, or seventh lateral well bore window in the main well bore.

If the running tool includes a pocket for storing the sheared distal ends of the shear rod, the method may include the step of causing the sheared first distal end of the shear rod retained by the catcher to be deposited in the pocket for storage.

If the outer surface of the stop/shear block also includes a plurality of shear grooves, the first distal end of the shear rod is sheared at one of the plurality of shear grooves by the shear surface of the stop/shear block.

If the shear rod engaging surface includes an adjustable calibration plate and the running tool further includes a calibration hole disposed above the plurality of shoulders on the shear rod, the method may also include a calibration step involving calibrating the reciprocating position of the shear rod by replacing the calibration plate with a second calibration plate having a different diameter than the calibration plate or by inserting one or more shims behind the calibration plate, observing through the calibration hole the position of the shoulders in the reciprocating position, and repeating as necessary to achieve the desired reciprocating position of the shear rod.

If the stop/shear block further includes an inspection window and the window locator further includes a shear bushing surrounding a portion of the outer surface of the shear rod, the method may further include the steps of observing through the inspection window the position of the shear bushing in relation to the first distal end and one of the plurality of shear grooves, and aligning the shear bushing with the shear groove by adjusting the position of the shear bushing.

The method may also include the steps of positioning the guide member adjacent to one of the first and second (or third) lateral well bore windows, anchoring the guide member in the main well bore, detaching the running tool from the guide member, pulling the running tool out of the main well bore, and deploying a second tubular containing a down-hole tool down the main well bore, through the one of the first or second lateral well bore windows, and into a lateral well bore, the wedge-shaped outer surface of the guide member acting to divert the down-hole tool from the main well bore, through the first or second lateral well bore window, and into the lateral well bore. The method may also comprise the step of causing the down-hole tool to perform remedial work on the lateral well bore.

The method may also involve deploying a third tubular containing a fishing tool down the main well bore, connecting the fishing tool to the guide member, disengaging the guide member from the main well bore, and pulling the guide member out of the main well bore. The main well bore may be a cased well bore. The tubular may be a work string, drill pipe, or coiled tubing. If the tubular is coiled tubing, the down-hole assembly may further include an indexing tool.

DETAILED DESCRIPTION OF THE PREFERRED EMBODIMENTS

Figure 1:
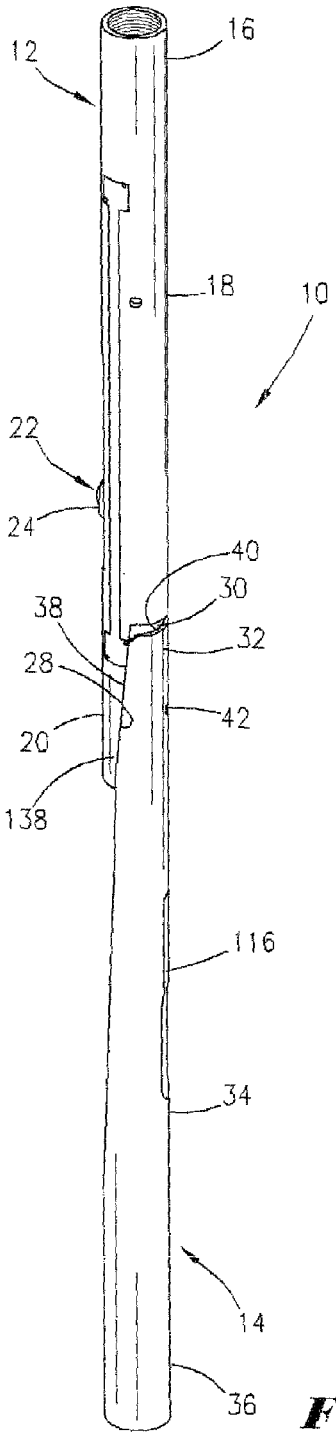
FIG. 1 is a perspective view of the running tool and guide member components of the down-hole assembly.
Figure 2:
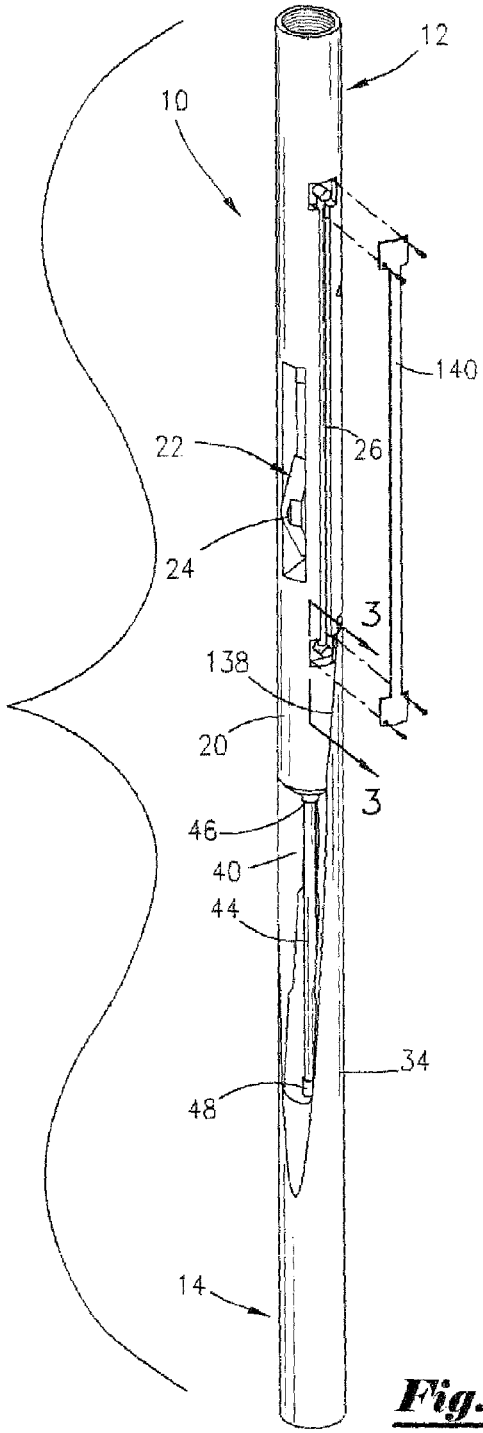
FIG. 2 is another perspective, partially exploded view of the running tool and guide member components shown in FIG. 1.

FIGS. 1 and 2 illustrate the present invention and show down-hole assembly 10 as including running tool 12 and guide member 14. Running tool 12 may be a cylindrical body made of hardened metal such as steel. Running tool 12 may include upper section 16, middle section 18, and lower section 20. The outer diameter ("OD") of running tool 12 may vary depending on the inner diameter ("ID") of the cased well bore that running tool 12 is positioned within. Running tool 12 may have an OD of 4½". Middle section 18 may contain window locator 22. Window locator 22 is substantially positioned internal of running tool 12. Head 24 of window locator 22 may be selectively movable and may extend external of running tool 12. A first internal bore (not shown) for passage of well-bore fluids extends through upper section 16. A second internal bore (not shown) for passage of well-bore fluids extends through lower section 20. Conduit 26 may fluidly connect the first internal bore in upper section 16 with the second internal bore in lower section 20. Conduit 26 may be any type of conduit capable of containing and flowing fluid there-through. Conduit 26 may be a supplementary internal bore in running tool 12. Conduit 26 may be hydraulic fluid tubing. Any number of tubing sizes may be used. For example, conduit 26 may have an OD of ½" and an ID of ⅜". Conduit 26 is necessary to bypass locator 22 which sets substantially internal of running tool 12. Conduit 26 may be covered by cover plate 140. While cover plate 140 is shown in one-piece, it is to be understood that cover plate 140 could be designed in separate pieces such as a two-piece or a three-piece design. Lower end 20 of running tool 12 contains cut-away portion 28. Cut-away portion 28 includes an outer surface 30 with a convex profile.

With reference to FIGS. 1 and 2, guide member 14 may be a cylindrical body made of hardened metal such as steel. Guide member 14 may include upper section 32, middle section 34, and lower section 36. The OD of guide member 14 may vary depending on the inner diameter of the cased well bore guide member 14 is positioned within. Guide member 14 may have an OD of 4½" particularly at lower section 36. An internal bore (not shown) may extend through guide member 14 from middle section 34 through lower section 36. The internal bore in guide member 14 may be in fluid communication with the internal bores and conduit 26 of running tool 12. Guide member 14 may have cut-away portion 38. Cut-away portion 38 may include outer surface 40 having a substantially concave profile. Outer surface 40 may extend from upper section 32, through middle section 34, to lower section 36. Outer surface 40 may terminate at lower section 36 or preferably at the beginning of lower section 36. Cut-away portion 40 may be tapered, inclined, or wedge-shaped; the thickness of cut-away portion 40 being less at upper section 32 of guide member 14 and gradually having a greater thickness in the middle section 34 and lower section 36 of guide member 14.

Again with reference to FIGS. 1 and 2, running tool 12 may be detachably secured to guide member 14. For instance, lower section 20 of running tool 12 may be detachably secured to upper section 32 of guide member 14. Preferably, cut-away portion 28 of running tool 12 may be detachably secured to portion 138 of cut-away portion 38 in upper section 32 of guide member 14. The convex profile of outer surface 30 of running tool 12 may cooperatively engage or mate with the concave profile of outer surface 40 of guide member 14. Running tool 12 and guide member 14 may be detachably secured by one or more securing means such as shear bolt 42. Running tool 12 and guide member 14 may also be detachably secured by a dove-tail joint (not shown). Guide member 14 may also include a retrieval slot 116 for fishing and retrieval of guide member 14.

As seen in FIG. 2, running tool 12 includes stinger pipe 44. Stinger pipe 44 has upper end 46 threadedly connected to lower section 20 of running tool 12. Upper end 46 may be threadedly connected to the end of the inner bore in lower section 20 of running tool 12. Lower end 48 of stinger pipe 44 is sealingly stung into the upper end of the internal bore in middle section 34 of guide member 14. This enables lower end 48 of stinger pipe 44 to slip out of or disengage from guide member 14 when running tool 12 is disconnected from guide member 14. Stinger pipe 44 provides fluid communication between the internal bores and conduit 26 of running tool 12 and the internal bore of guide member 14. Stinger pipe 44 may be any diameter depending on the ID of the internal bores in running tool 12 and guide member 14 and/or the desired volume and velocity of fluid to be communicated through pipe 44 to guide member 14 or any additional subs operatively connected to guide member 14. The length of stinger pipe 44 may depend on the distance required to provide fluid communication between running tool 12 and guide member 14. Stinger pipe may be 1" NPT stinger pipe. Upper and lower ends 46, 48 of stinger pipe 44 may contain an o-ring nose for detachably sealing with the internal bore in lower section 20 of running tool 12 and guide member 14, respectively.

Figure 3:
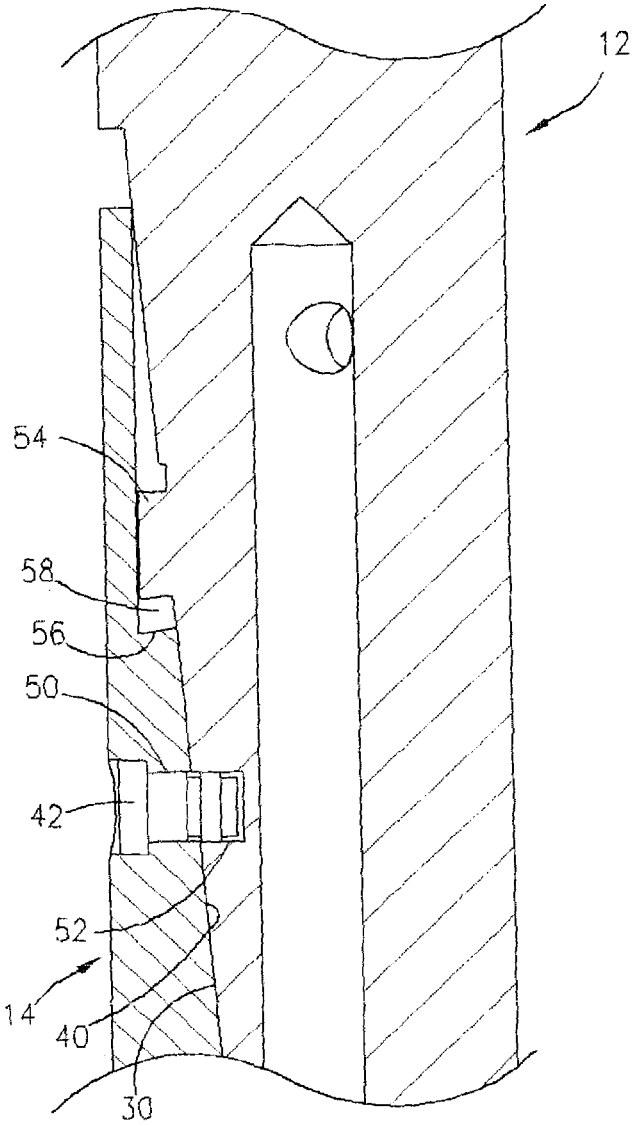
FIG. 3 is a cross-sectional partial view of the dovetail and shear bolt connecting the running tool and guide member components of the down-hole assembly.

FIG. 3 shows the detachable connection between running tool 12 and guide member 14. Shear bolt 42 is shown in a securing position. Shear bolt 42 sets within recess 50 in guide member 14 and recess 52 in running tool 12. Shear bolt 42 is designed to shear at a predetermined force. The predetermined shearing force may vary depending on the equipment used in the operation. Shear bolt 42 may be a 5½" X-1 shear bolt. Shear bolt 42 may shear at forces from 15 K to 28 K. Shear force can be reduced when down-hole assembly 10 is run with coiled tubing, which requires an upward shearing force. When shear bolt 42 is sheared, running tool 12 substantially disconnects or detaches from guide member 14 permitting running tool 12 and stinger pipe 44 to be pulled out of the cased well bore. For a variety of safety and operational reasons, the dovetail joint between running tool 12 and guide means 14 is provided. The dovetail joint includes first dovetail member 54 in running tool 12 and second dovetail member 56 in guide member 14. Gap 58 may be provided between first dovetail member 54 and second dovetail member 56. The size of gap 58 may vary. Gap 58 may be sized so as to permit ⅝" travel of first dovetail 54 relative to second dove tail 56. The dovetail joint between running tool 12 and guide member 14 prevents running tool 12 from going into a window in the cased well bore after shear bolt 42 has been sheared. The dovetail joint also prevents wedging between running tool 12 and guide member 14, which keeps any anchoring means from being pulled or released prematurely. The dovetail joint further prevents stinger pipe 44 from coming out of line with the seal of the internal bore in guide member 14 before removal is desired. When running a window finder job with pipe, the dovetail joint will permit weight to be set on any anchoring means being used. FIG. 3 also shows the internal fluid passage bore in lower end 20 of running tool 12.

Figure 4:
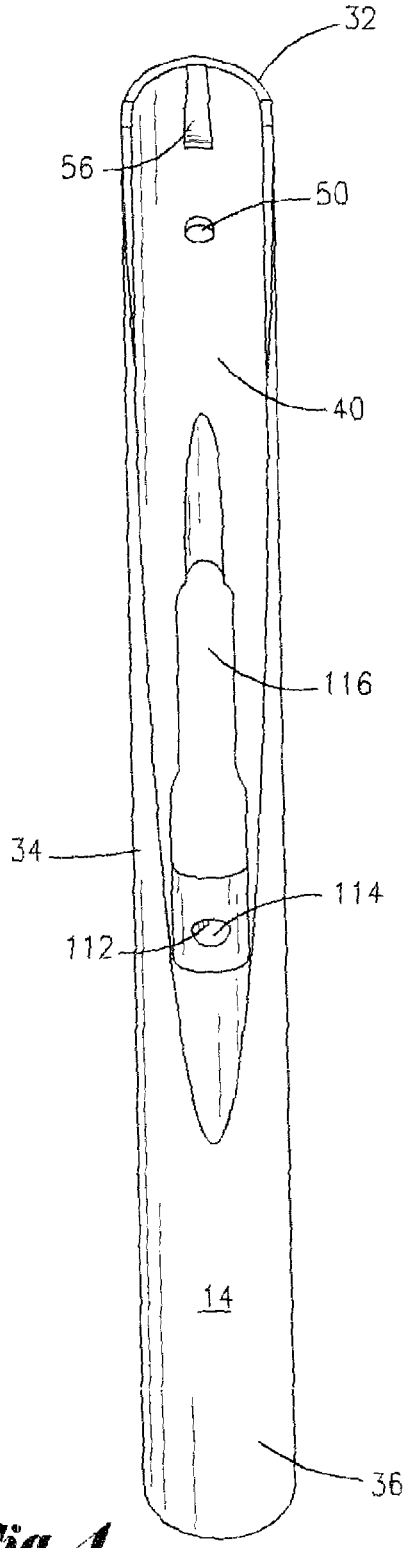
FIG. 4 is a side view of the guide member component of the down-hole assembly.

FIG. 4 illustrates guide member 14 without attachment of running tool 12 and stinger pipe 44. Guide member 14 has dovetail member 56, which provides a slot to receive and engage dovetail member 54 in running tool 12. Recess 50 for placement of shear bolt 42 is shown. Seal bore opening 112 is positioned in guide member 14. Opening 112 sealingly receives lower end 48 of stinger pipe 44. Internal bore 114 is shown. Bore 114 extends through middle section 34 and lower section 36 of guide member 14. The dovetail slot in dovetail member 56, as well as opening 112, are sized so as not to provide an attachment means for the fishing tool that removes guide member 14 from the well bore. Guide member 14 may have retrieval slot 116 that provides the attachment means for the retrieval or fishing tool used to remove guide member 14 from the well bore. Slot 116 may be configured to receive a hook on the fishing or retrieval tool.

Figure 5:
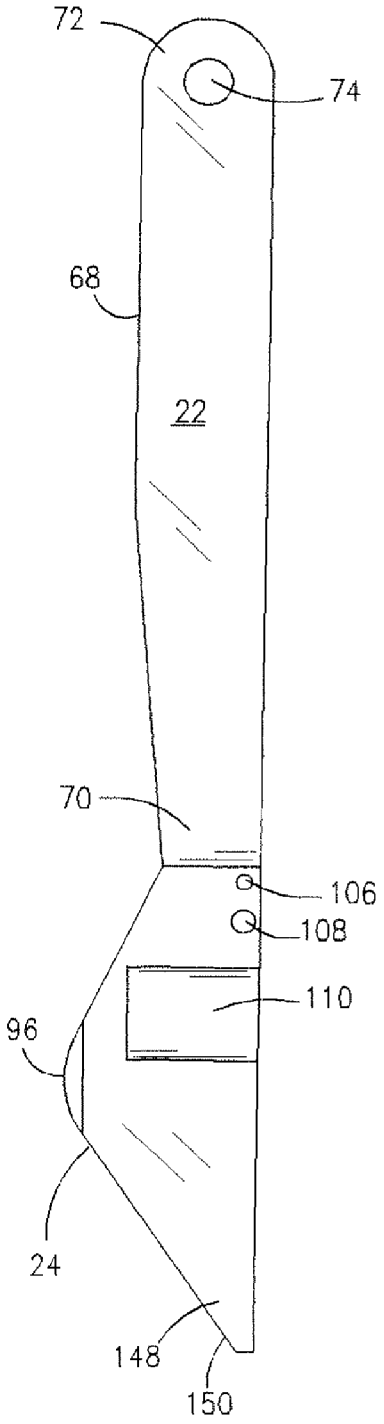
FIG. 5 is a side view of the window locator component of the down-hole assembly.
Figure 6:
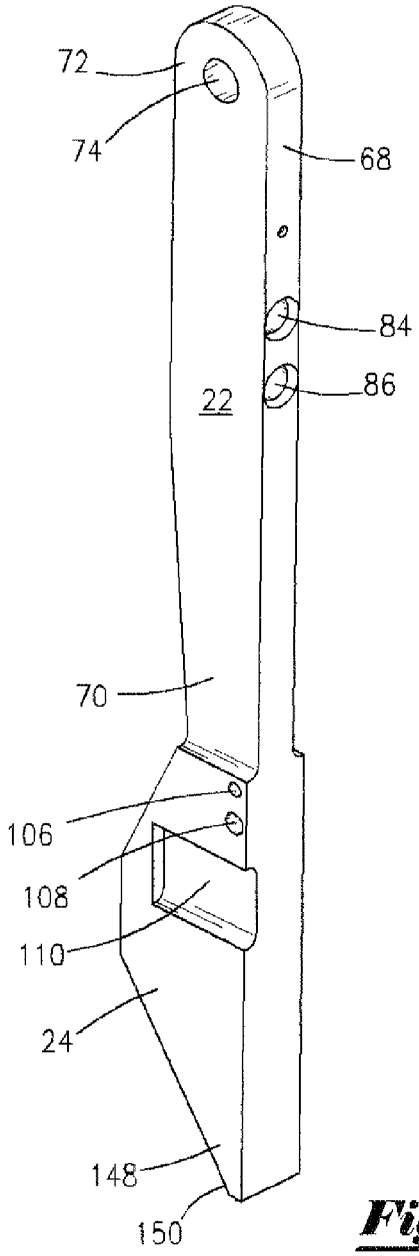
FIG. 6 is a perspective view of the window locator component of the down-hole assembly shown in FIG. 5.
Figure 7:
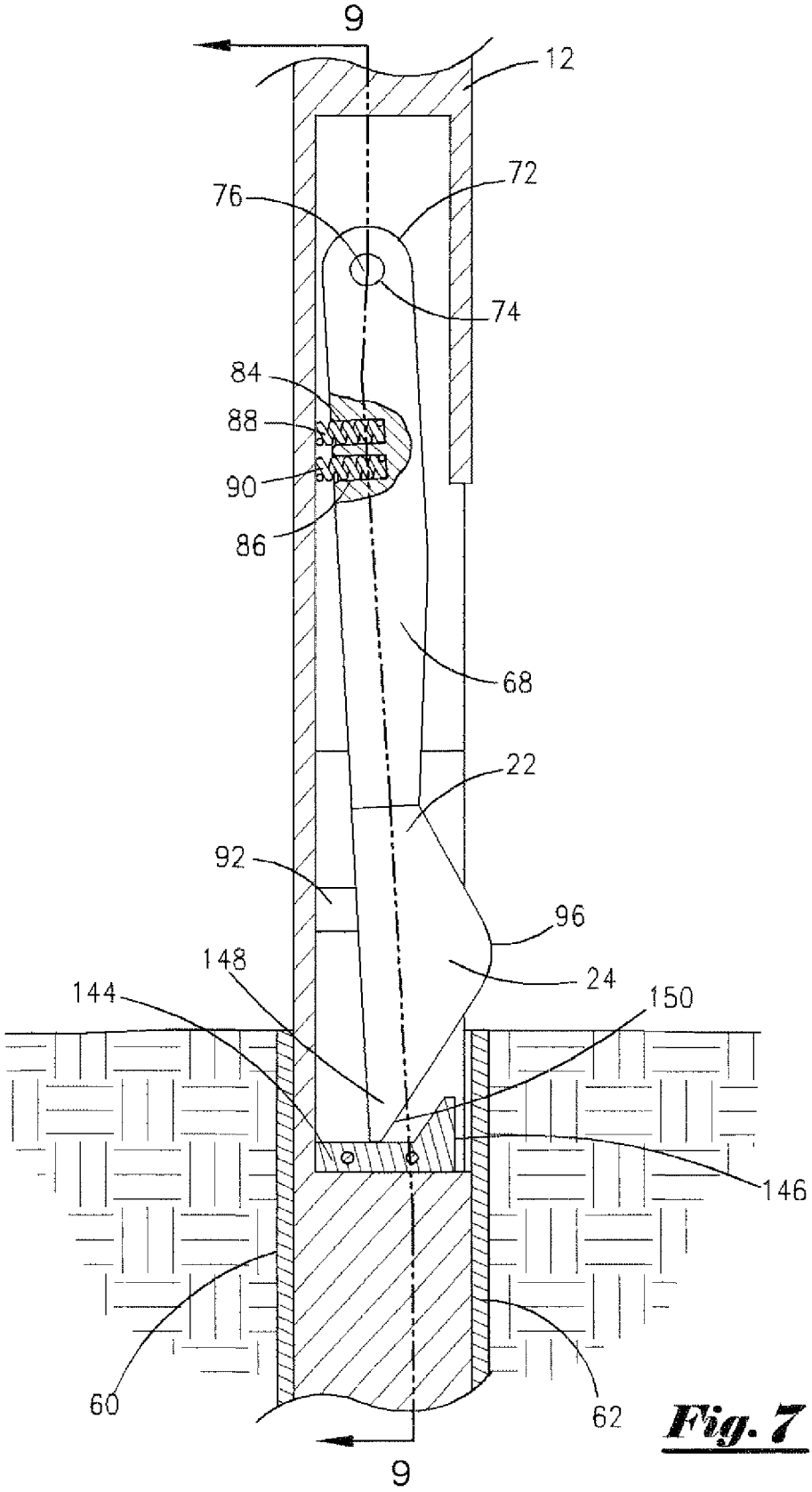
FIG. 7 is a partial cross-sectional side view of the running tool component of the down-hole assembly with the window locator in a run-in position.

As shown in FIGS. 5-7, window locator 22 may include pivot arm 68 with proximal end 70 and distal end 72. Head 24 may be connected to pivot arm 68 at distal end 70. Head 24 may be generally triangular-shaped with apex 96. Head 24 includes proximal end 148. Proximal end 148 has outer edge surface 150. Head 24 and pivot arm 68 may be a unitary piece. Window locator 22 may be made of hardened metal such as steel. Proximal end 72 of pivot arm 68 may contain pivot hole 74. Hinge pin 76 may be placed within pivot hole 74 and secured to running tool 12 in order to maintain the positioning of proximal end 72 relative to running tool 12 and act as a pivot point for window locator 22.

Again with reference to FIGS. 5-7, pivot arm 68 may contain recesses 84, 86. Biasing means 88, 90 may be positioned in recesses 84, 86, respectively. Biasing means 88, 90 may be springs. Although shown with two biasing means 88, 90, it is to be understood that running tool 12 could have one biasing means or three or more biasing means depending on the size and strength of the biasing means and/or the size and configuration of window locator 22. For example, seven biasing means may be provided with seven corresponding recesses to house the biasing means. Biasing means 88, 90 bias window locator 22 in an outward or external direction relative to a central longitudinal axis extending through running tool 12. Head 24 pivots or swings away from and external to the outer housing of running tool 12 unless otherwise held in place within running tool 12. Head 24 may contain recess 110 that may cooperate with the upper end of housing 92. Recess 110 may act as a guide for head 24 as head 24 pivots outward or inward relative to the outer housing of running tool 12.

Figure 8:
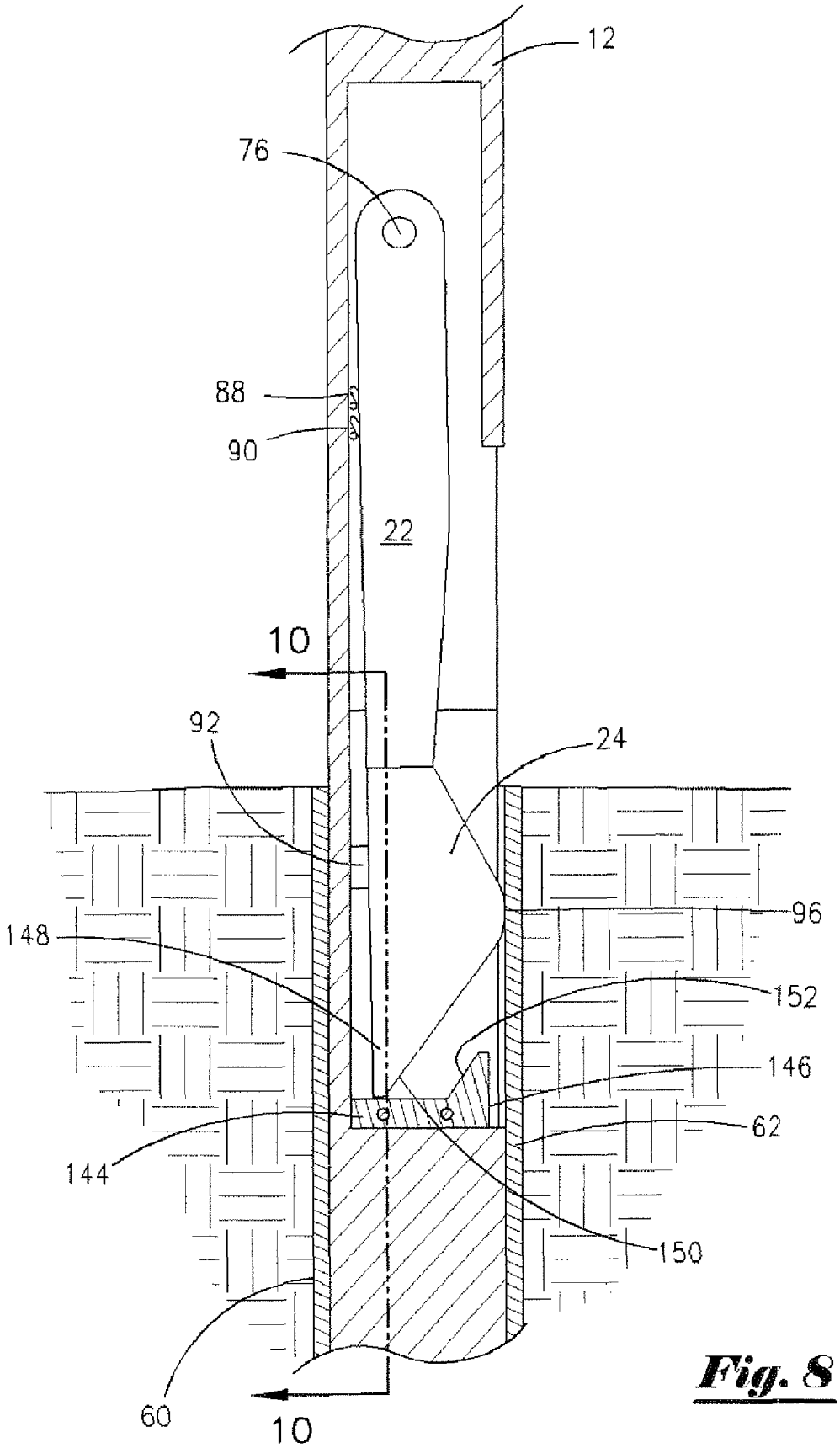
FIG. 8 is a partial cross-sectional side view of the running tool component of the down-hole assembly with the window locator in a retracted position.
Figure 11:
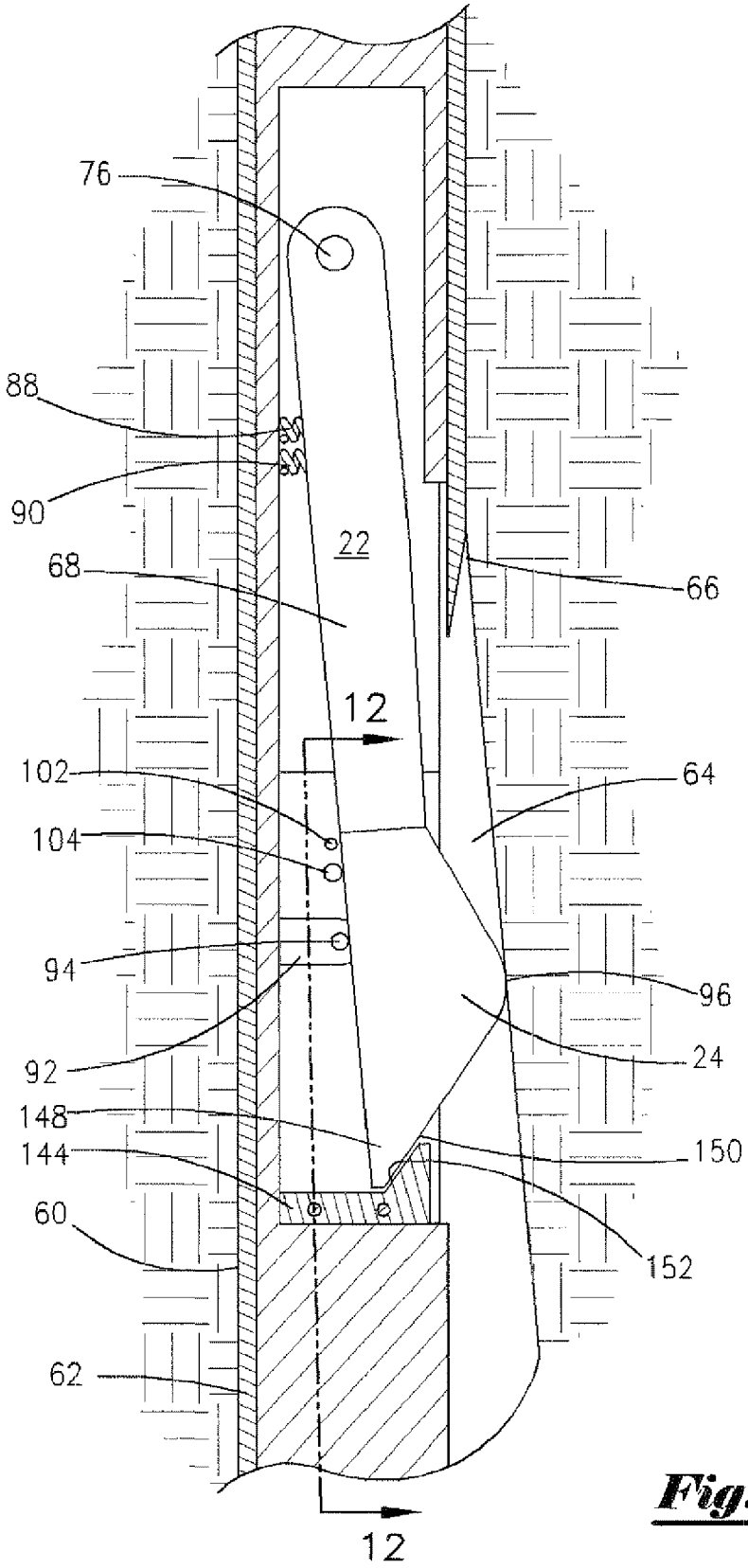
FIG. 11 is a partial cross-sectional side view of the running tool component of the down-hole assembly with the window locator in a window locating position.

As shown in FIGS. 7, 8 and 11, running tool 12 may include block 144. Block 144 may be positioned internal of running tool 12 and in operative association with window locator 22. Block 144 may be L-shaped with shoulder 146. Shoulder 146 may be adapted to receive window head 24 of window locator 22 to thereby restrict the maximum outward pivoting angle of window locator 22. Head 24 of window locator 22 may only pivot outwardly (external to running tool 12) to a point where outer edge surface 150 of proximal end 148 of head 24 abuts surface 152 of shoulder 146 of block 144. Block 144 therefore acts as a stop for the outward pivoting of window locator 22. Block 144 may be made of hardened metal such as steel. Block 144 may be affixed to running tool 12 by any fixation means such as a pin in which case both block 144 and running tool 12 would have a recess to receive the pin. One or more pins may be used to affix block 144 to running tool 12. For example, two pins may be used to affix block 144 to running tool 12. Both block 144 and running tool 12 would each have two recesses to receive the respective two pins. While shown as a separate piece, it is to be understood that block 144 could be made integral with running tool 12.

Figure 9:
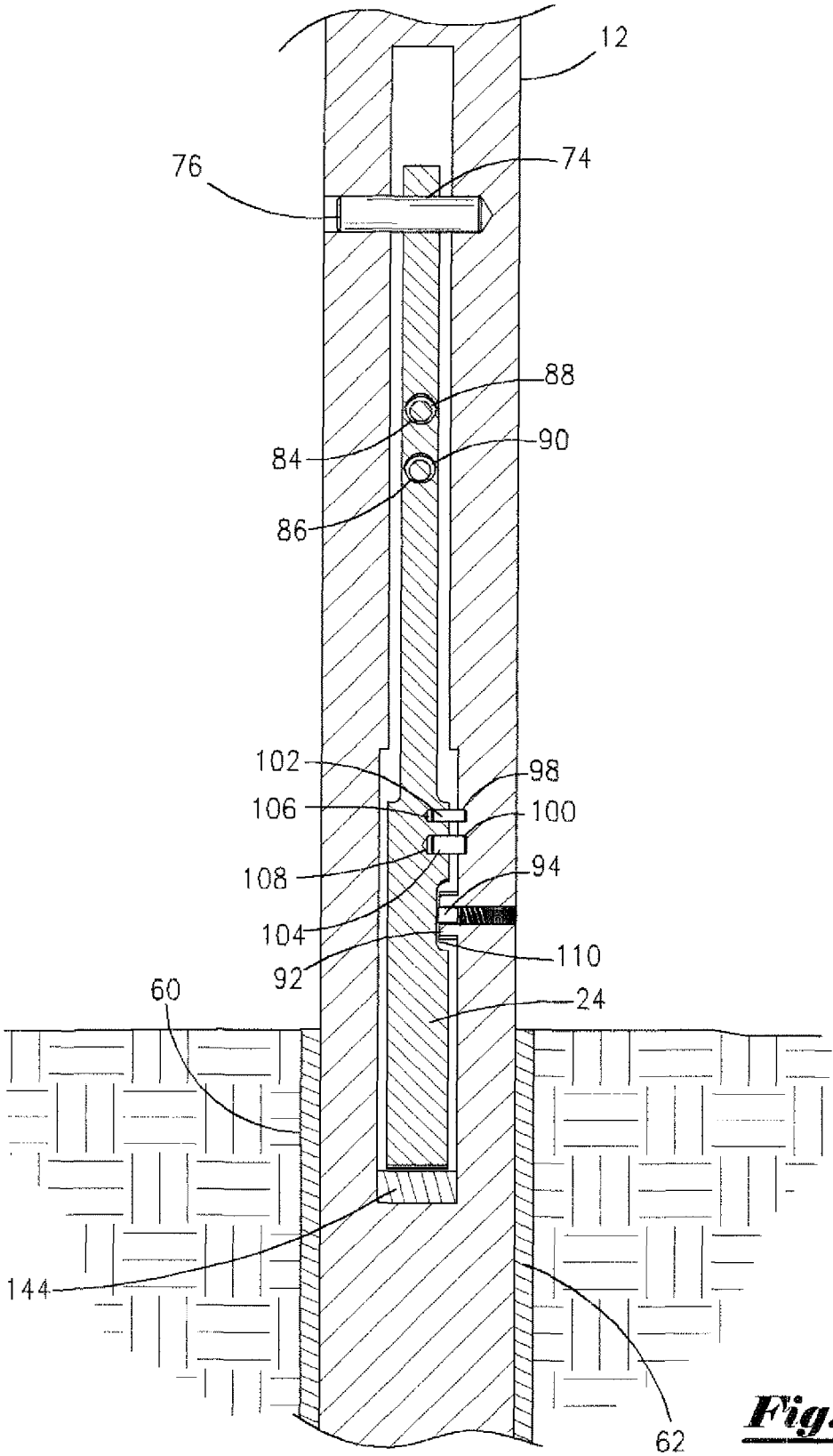
FIG. 9 is a partial cross-sectional side view of the running tool component of the down-hole assembly taken along line 9-9 of FIG. 7.

FIGS. 7 and 9 illustrate window locator 22, and more particularly, head 24, in a run-in position. Running tool 12 may contain recesses 98, 100. Recesses 98, 100 may contain shear pins 102, 104, respectively. Head 24 contains cooperating recesses 106, 108. When down-hole assembly 10 is first assembled for operation, shear pins 102, 104 hold head 24 in a stationary position. Head 24 may be held stationary at an OD of 5½" based on a cross-sectional measurement of running tool 12. Head 24 is held stationary because the proximal end of shear pins 102, 104 are set within recesses 99, 100, respectively, and the distal ends of shear pins 102, 104 are set within recesses 106, 108, respectively. When down-hole assembly 10 is run down well bore 60, assembly 10 may reach casing or tubing 62 having an inner bore wall with an ID greater than the OD of running tool 12 at apex 96 of head 24 (e.g., ID smaller than 5½"). Head 24 will contact the larger ID of the inner casing wall. Due to the downward force being applied to down-hole assembly 10, head 24 will be forced inward causing shear pins 102, 104 to shear thereby freeing window locator 22 from its stationary position. Window locator 22 is now free to pivot respective to the pivot point at pivot hole 74. Shear pins 102, 104 may be sized the same so that both shear at the same predetermined force. Alternatively, shear pins 102, 104 could be sized differently and therefore shear at different forces. Depending on the work string weight, only one shear pin 102 or 104 could be used in running tool 12; its size determined by the particular work string weight and amount of force capable of being generated to shear either shear pin 102 or 104. Moreover, running tool 12 could be provided with more than two shear pins 102, 104. For example, running tool 12 could have two additional shear pins 102, 104 (not shown) and corresponding recesses 98, 100 (not shown) positioned directly opposite shear pins 102, 104 and recesses 98, 100 shown in FIG. 7. The two additional shear pins 102, 104 could be sized the same so that both shear at the same predetermined force. Alternatively, additional shear pins 102, 104 could be sized differently and therefore shear at different forces. By including four shear pins, a wider range of shear values is achieved. One or more of the four shear pins 102, 104 could be used based on the work string weight that generates the shearing force.

Figure 10:
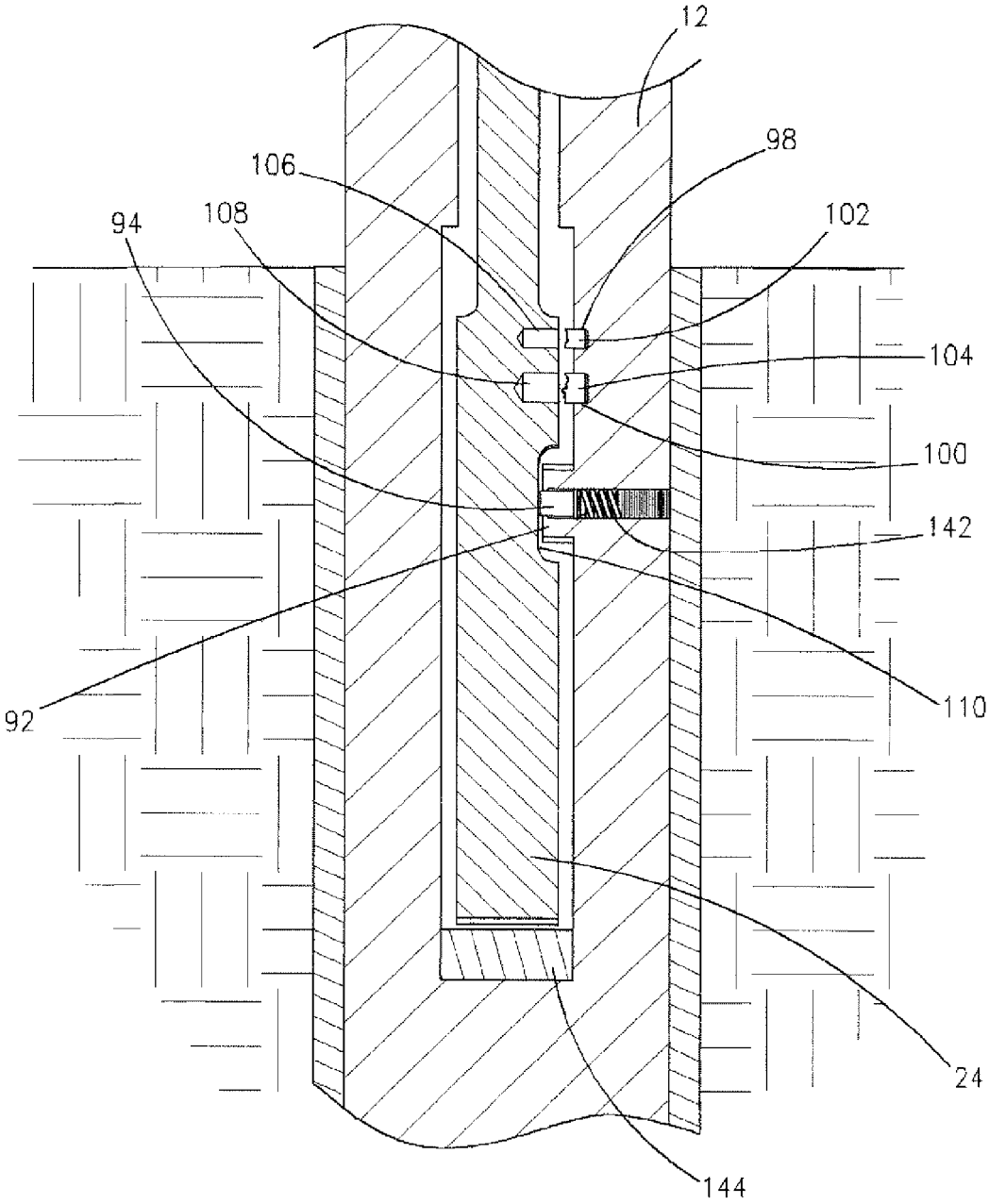
FIG. 10 is a partial cross-sectional side view of the running tool component of the down-hole assembly taken along line 10-10 of FIG. 8.

FIGS. 8 and 10 show window locator 22, and more particularly head 24, in its retracted position after shear pins 102, 104 have been sheared due to retraction forces applied to head 24 by the smaller ID inner wall of casing 62. Although window locator 22 is biased outward, the inner wall of casing 62 prevents head 24 from pivoting in a direction external of running tool 12. Head 24 covers the recess in housing 92 that contains movable shear pin 94 until actuated as described below. Movable shear pin 94 may be a spring loaded shear pin. Biasing means 142 bias shear pin 94. Biasing means 142 may be a spring.

Figure 12:
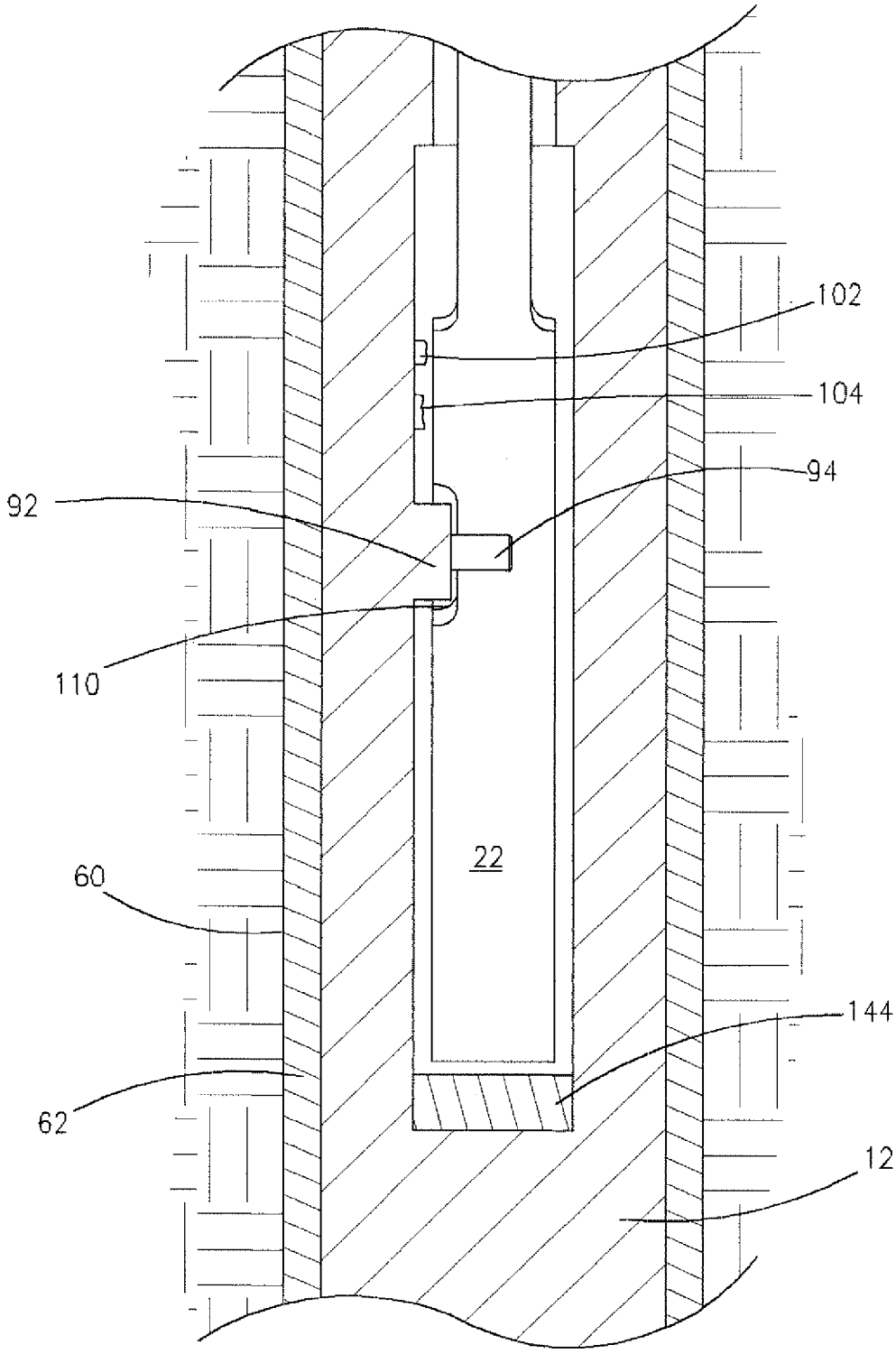
FIG. 12 is a partial cross-sectional side view of the running tool component of the down-hole assembly taken along line 12-12 of FIG. 11.

FIGS. 11 and 12 show window locator 22, and more particularly window locating head 24, in its window locating position. As previously mentioned, biasing means 88, 90 bias head 24 of window locator 22 outwardly and in a direction external of running tool. As down-hole assembly 10 is run down-hole, apex 96 of head 24 is biased against the inner bore wall of casing 62 (FIG. 8). When window locator 22 encounters window 64, a portion of window locating head 24 is biased into window 64 achieving its fully extended or window locating position (e.g., 6⅜" OD). Once head 24 swings outwardly and external to the outer housing of running tool 12 past a predetermined point, head 24 may be temporarily prevented from moving back or retracting into running tool 12 by the expansion of shear pin 94. The expansion of shear pin 94 takes place when head 24 swings past the recess in housing 92. Biasing means 142 expand and force shear pin 94 to an extended position sufficient to impede head 24 from pivoting backward into running tool 12. Shear pin 94 may extend out of the recess in housing 92 by about ⅜" to act as a backstop for head 24. Shear pin 94 may be a spring loaded 10K shear pin. Preferably, housing 92 and shear pin 94 are positioned such that shear pin 94 expands to its stop position when apex 96 of head 24 reaches an OD of 6⅜" based on a cross-sectional measurement of running tool 12. Shear pin 94 is designed so that when a predetermined amount of force is applied during the removal of running tool 12 from well bore 60 after dislodgment from guide member 14, shear pin 94 will shear thereby permitting head 24 of window locator 22 to pivot back into or towards running tool 12 and return to its retracted position for removal from well bore 60. While shown with one shear pin 94, it is to be understood that more than one shear pin 94 may be used. For example, two shear pins 94 could be provided with respective biasing means 142 associated therewith in respective recesses.

Figure 13A:
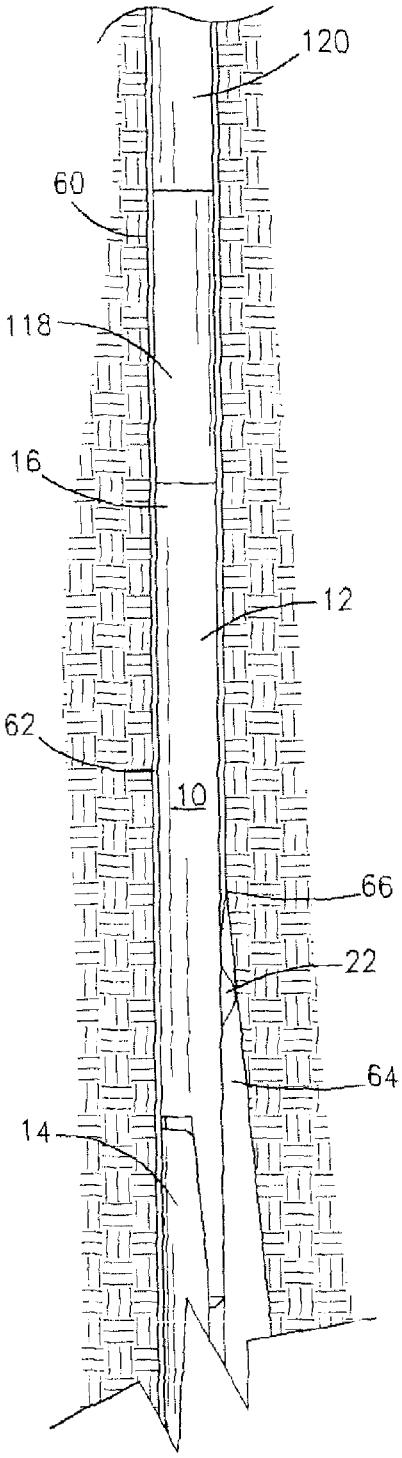
FIGS. 13A and 13B are a sequential side view of the down-hole assembly deployed in a main well bore with the window locator in a window locating position.
Figure 13B:
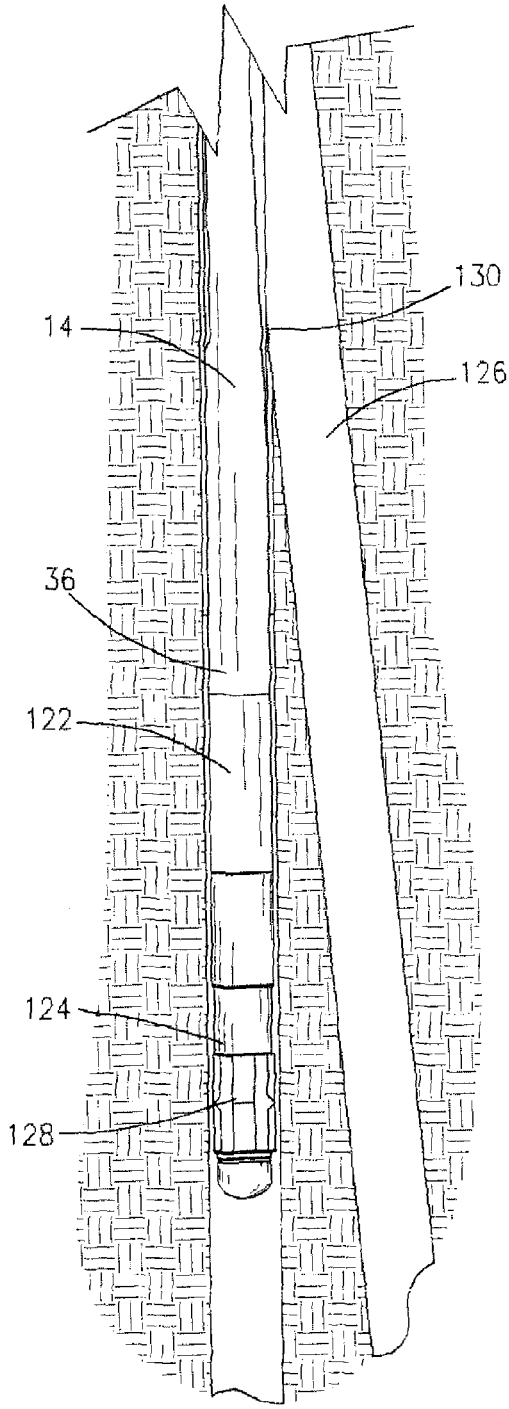

FIGS. 13A and 13B illustrate down-hole assembly 10 run in main well bore 60 to a position adjacent window 64. Main well bore 60 may be a vertical, horizontal or deviated well. Window 64 begins at upper edge 66 and ends at lower edge 130, which is the point where lateral well bore 126 begins. Window locator 22 is shown with head 24 in its fully extended or window locating position external to the outer housing of running tool 12 and within window 64. Down-hole assembly 10 includes diverter sub 118 operatively connected to running tool 12. Diverter sub 118 may be threadedly connected to upper section 16 of running tool 12. Diverter sub 118 is commercially available from RT Manufacturing under model name FD-287. The upper end of diverter sub is operatively connected to tubular 120. Tubular 120 may be a work string such as drill pipe or coiled tubing. In the case of coiled tubing, an indexing tool may be operatively connected to diverter sub 118. The indexing tool is commercially available from RT Manufacturing under model name IT-412.

As revealed in FIGS. 13A and 13B, down-hole assembly 10 further includes debris sub 122 operatively connected to guide member 14. Debris sub 122 may be threadedly connected to lower section 36 of guide member 14. Debris sub 122 is commercially available from Knight Fishing Services under model name SUBEXD350IF.

As also shown in FIGS. 13A and 13B, down-hole assembly 10 may also include anchor sub 124 operative connected to debris sub 122. Anchor sub 124 may be threadedly connected to the lower end of debris sub 122. Anchor sub 124 may contain anchoring means to detachably secure down-hole assembly 10 within well bore 60 at a desired location. Such desired location may be the location where guide member 14 is adjacent to window 64 leading into lateral well bore 126. The anchoring means of anchor sub 124 may be one or more slips 128 such as hydraulically activated slips. Anchor sub 124 is commercially available from RT Manufacturing under model name ACH550.

With reference to FIGS. 13A and 13B, as down-hole assembly 10 is run down well bore 60, window locator 22 is placed adjacent to window 64. Head 24 is no longer restricted by the inner bore wall of casing 62 of well bore 60 and therefore is biased to its maximum pivoting radius and is prevented from retreating back into running tool by shear pin 94. Window locator 22 is locked in place. This allows weight to be applied in either an upward or downward direction. When assembly 10 is pulled upward, head 24 will encounter point 66 which signals the beginning of window 64. When assembly 10 is pushed downward, head 24 will encounter lower edge 130 which signals to bottom edge of window 64 where lateral well bore 126 commences. Accordingly, the operator is able to determine the location of window 64 in well bore 60 as well as its dimensions. The operator is now able to position assembly 10 at a point where guide member 14 will cause the diversion of a tubular (e.g., a work string containing a milling or drilling bit) into lateral well bore 126.

Again with reference to FIGS. 13A and 13B, with assembly 10 and more particularly guide member 14 in position, the operator will activate anchor sub 124 to set slips 128. Slips 128 may be activated in a variety of ways. Slips 128 may be activated by hydraulic fluid pressuring a piston in anchor sub 124 to set slips 128 against the inner wall of casing 62 in well bore 60. The hydraulic fluid pressure may be supplied to anchor sub 124 by fluid pressure contained within assembly 10. Assembly 10 may have a fluid path running there-through. For example, an internal bore in diverter sub 118 may be in fluid communication with the first internal bore in upper section 16 of running tool 12, which in turn is in fluid communication with the second internal bore in lower section 20 of running tool 12 via conduit 26. The second internal bore in lower section 20 of running tool 12 is in fluid communication with the internal bore extending through guide means 14 via stinger pipe 44. The internal bore in guide member 14 is in fluid communication with an internal bore in debris sub 122, which in turn is in fluid communication with an internal bore in anchor sub 124. Thus, fluid pressure may be pressured up to reach a predetermined pressure sufficient to activate slips 128. Diverter sub 118 may include a ball or dart valve seat. Increasing the fluid pressure for activation of slips 128 may require that a ball or dart be dropped from the well surface through tubular 120 to diverter sub 118 where the ball or dart sets in the valve seat of diverter sub 118 to close and divert fluid passage through the valve so that anchor sub 124 may be activated to place slips 128 in their anchoring position. This operation is well known to one of ordinary skill in the art.

Figure 14A:
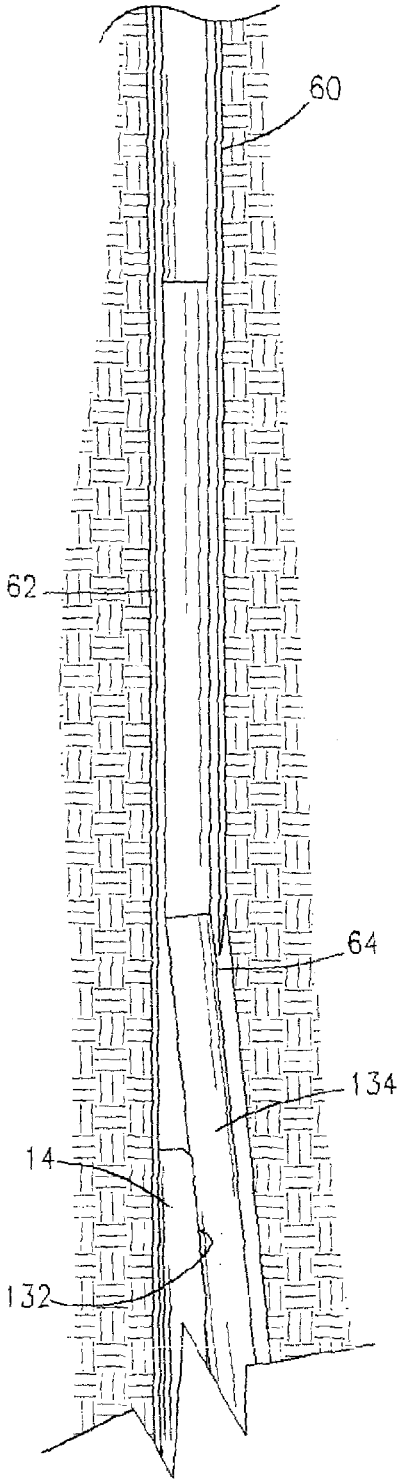
FIGS. 14A and 14B are a sequential side view of the guide member component of the down-hole assembly in an operational and anchored position in a main well bore.
Figure 14B:
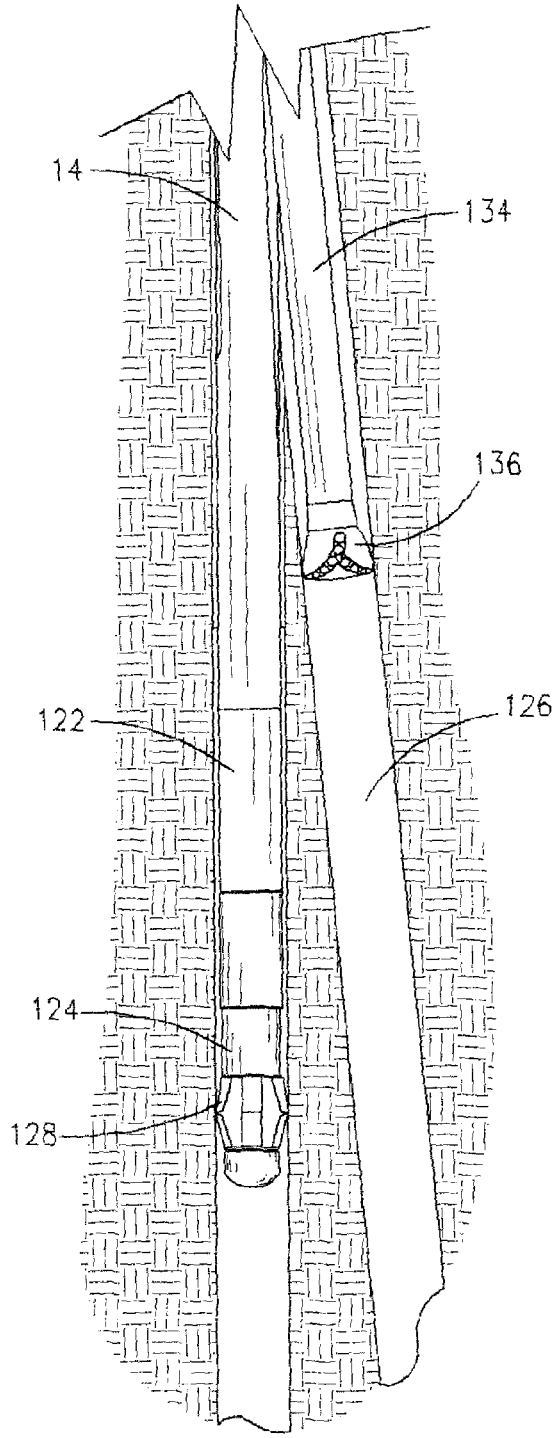

With reference to FIGS. 14A and 14B, after slips 128 are set, running tool 12 is released from guide member 14. A downward force is applied to running tool 12 (or an upward force in the case where tubular 120 is coiled tubing) sufficient to shear bolt 42. The assembly of diverter sub 118, running tool 12, and stinger pipe 44 is dislodged from guide member 14 and pulled out of well bore 60 leaving the assembly of guide member 14, debris sub 122 and anchor sub 124 positioned in well bore 60. Guide member 14 includes inclined or wedge shaped surface 132, which acts to divert or direct a tubular, such as tubular 134 containing milling bit 136, into window 64 and/or lateral well bore 126. Guide member 14 (namely inclined or wedged shaped surface 132) guides various equipment in and out of window 64 and/or lateral well bore 126 in order to carryout a variety of operations. For example, lateral well bore 126 may be cleaned out to restore production. Lateral well bore 126 may be re-drilled. A liner may be installed in lateral well bore 126. Other remedial work requiring a guide in and out of lateral well bore 126 may be performed.

After completion of the work, the assembly of guide member 14, debris sub 122 and anchor sub 124 may be removed from well bore 60. A retrieval or fishing tool may be sent down well bore 60 to retrieve the assembly. Such retrieval tools are commercially available from Knight Fishing Services under model name 7"STANDARDWHSTK-RETHK.

The fishing tool may have a retrieving device such as a hook that connects to retrieval slot 116 in guide member 114. Once connected, the fishing tool, together with the assembly of guide member 14, debris sub 122 and anchor sub 124, would be extracted or pulled out of well bore 60. Slips 128 would disengage from the inner wall of the casing in well bore 60 due to sufficient pulling force being applied to anchor sub 124.

Figure 15:
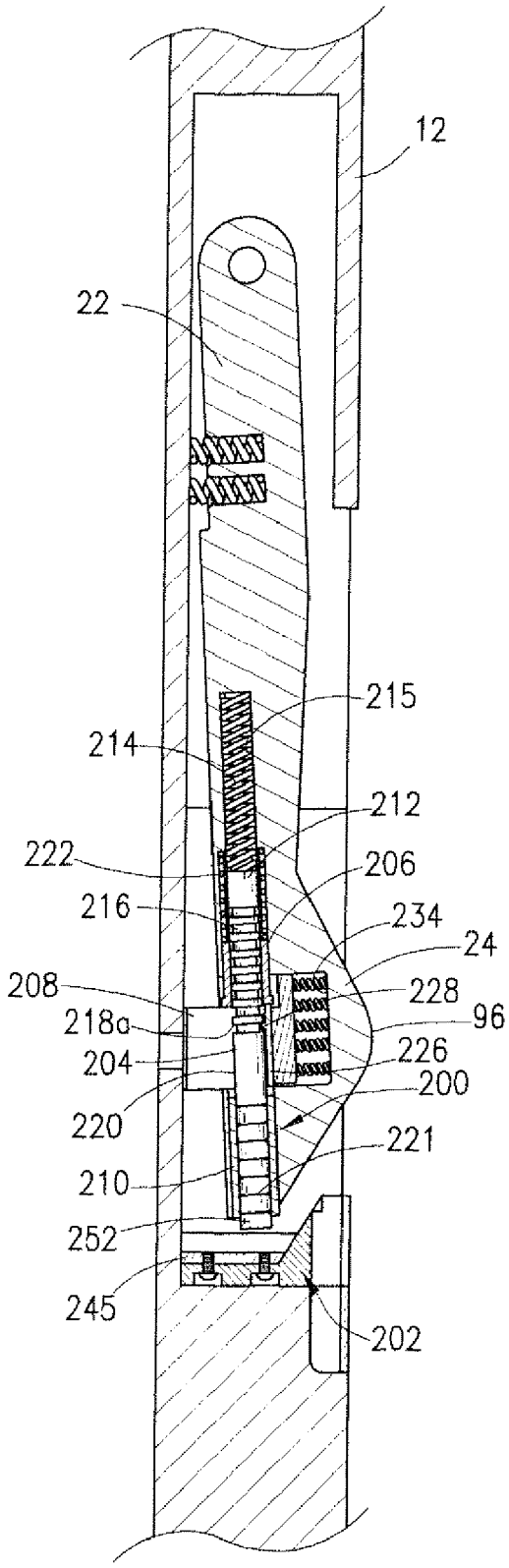
FIG. 15 is a partial cross-sectional side view of the alternative embodiment of the running tool component of the present invention.
Figure 16:
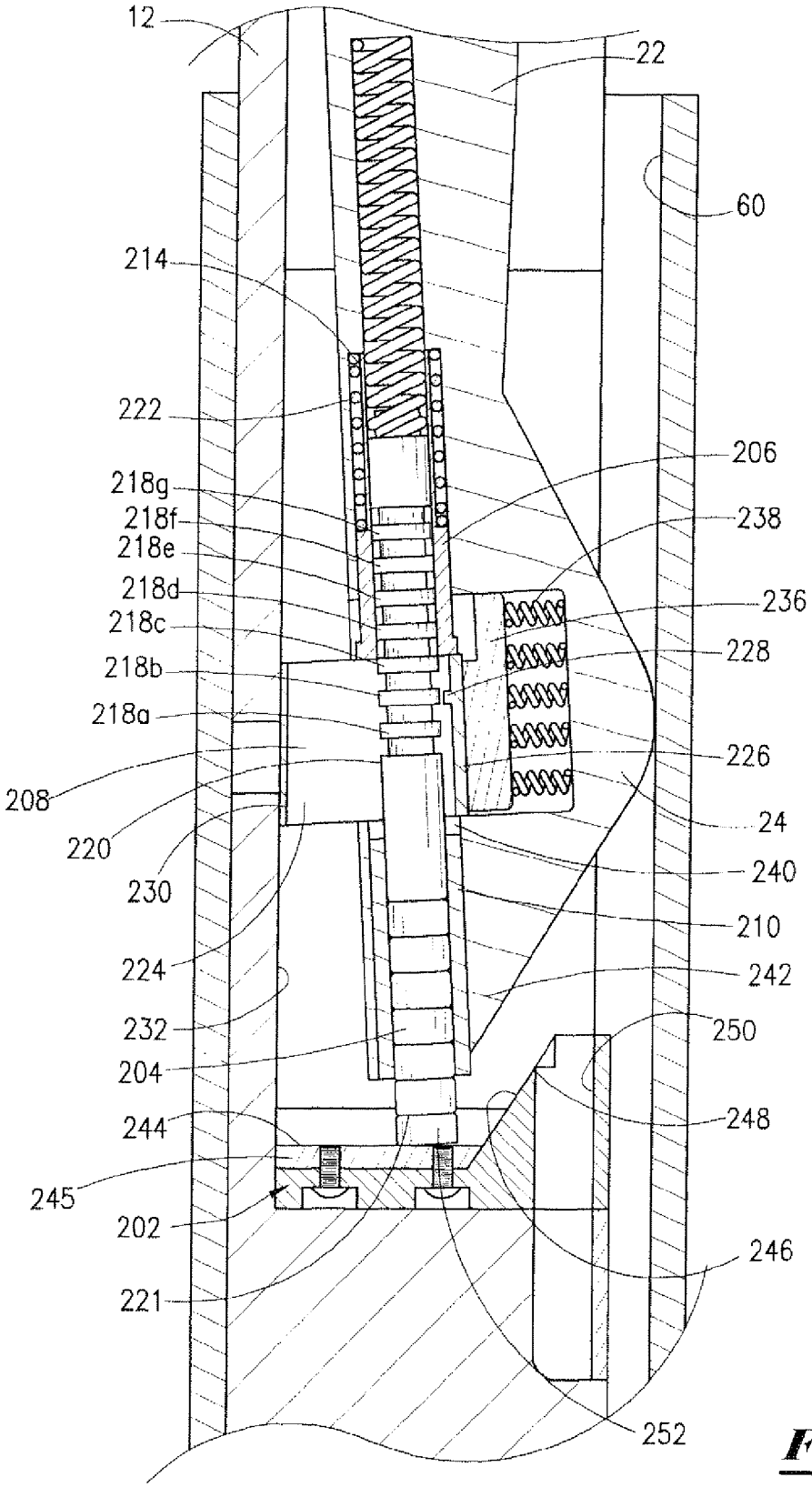
FIG. 16 is a partial cross-sectional side view of the alternative running tool component shown in FIG. 15 with the head of the window locator compressed to a first position.

FIGS. 15 and 16 show an alternative running tool 12 for down-hole assembly 10 that enables assembly 10 to locate multiple windows 64 in main well bore 60 while remaining down-hole. To provide the multiple-window locating function, window locator 22 (after being biased into a first window 64 and temporarily held in this position while the boundaries of first window 64 are determined) must be capable of retracting within running tool 12 for repositioning within casing 62, capable of being biased into a second window 64, and capable of being temporarily held in position so the upper and lower boundaries of the second window 64 may be determined. The process must also be able to be repeated for other windows such as third, fourth, fifth, sixth, and seventh lateral well bore window. These capabilities are achieved in alternative running tool 12 by shear rod assembly 200 and stop/shear block 202.

As seen in FIGS. 15 and 16, assembly 200 is operatively associated with window locator 22. Assembly 200 includes shear rod 204 contained within spring loaded bushing 206, dog assembly 208 and shear bushing 210. Proximal end 212 of rod 204 is operatively engaged to spring means 214 contained in recess 215 in window locator 22. Spring means 214 may be one or more springs. Section 216 of rod 204 contains two or more shoulders 218 on outer surface 220 as for example, shoulders 218*a*, 218*b*, 218*c*, 218*d*, 218*e*, 218*f*, and 218*g*. Rod 204 may contain two or more shear grooves 221 on outer surface. Rod 204 may be made of any type of hardened material such as a metal capable of shearing at a certain predetermined force. Rod 204 may be composed of brass.

In a preferred embodiment, rod 204 is approximately 9.587 inches in length having a diameter of approximately 0.625 inches. In this embodiment, shoulders 218 have lengths of approximately 0.125 inches each, and the portions of rod 204 between shoulders 218 are approximately 0.250 inches in length each with diameters of 0.425 inches. Shear grooves 221 are each composed of an angular surface and a perpendicular surface which intersect at a 30 degree angle. The diameter of rod 204 at this intersection in each groove 221 is approximately 0.545 inches. The perpendicular surfaces of grooves 221 are approximately 0.375 inches apart. In this embodiment, proximal end 212 of rod 204 includes an end section having a length of approximately 0.25 inches and a diameter of approximately 0.35 inches. The remainder of proximal end 212 is approximately 0.662 inches in length. The portion of rod 204 between shoulders 218 and shear grooves 221 is approximately 3.175 in length.

Again with reference to FIGS. 15 and 16, spring 222 is operatively engaged with spring loaded bushing 206 and biases bushing 206 into sliding engagement with dog assembly 208. Dog assembly 208 contains internal area 224 through which rod 204 passes. Dog assembly 208 has upper section 226 containing dog 228 that selectively engages with one or more shoulders 218*a*-218*g* of rod 204. Dog 228 may be formed in different sizes such as 1/16". Lower section 230 of dog assembly 208 extends external to window locator 22 and may engage floor 232 of running tool 12. Dog assembly 208 is movable within recess 234 of head 24. Floating plate 236 is contained within recess 234 and cooperatively engages upper section 226 of dog assembly 208 via spring means 238. Floating plate 236 may be made of any type of hardened material, such as brass. Spring means 238 may be one or more springs. Preferably, eight springs 238 are employed. Dog assembly 208 sets adjacent shear bushing 210. Gap 240 in head 24 of window locator 22 may separate dog assembly 208 from shear bushing 210. Shear bushing 210 is positioned at end 242 of head 24 and partially extends external to head 24 adjacent to block 202. Block 202 includes engaging surface 244 extending to tapered surface 246. Block 202 also includes shear surface 248 and stop shoulder 250. Engaging surface 244 may include calibration plate 245 mounted to block 202 with bolts.

Figure 23:
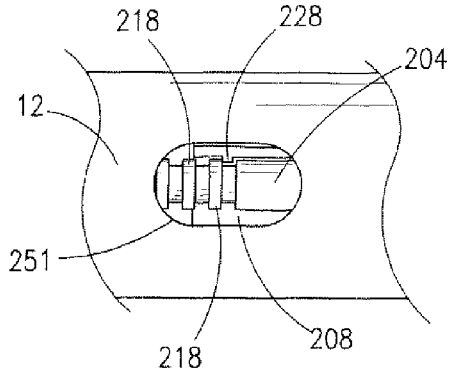
FIG. 23 is a side view of the alternative running tool of the present invention showing the calibration hole.

Referring to FIGS. 16 and 23, the body of running tool 12 includes calibration hole 251 over dog 228. Shear rod 204 may be calibrated such that dog 228 initially contacts shear rod 204 in the center of the large grooves between shoulders 218. The position of dog 228 may be viewed through calibration hole 251. Calibration of shear rod 204 may be accomplished by replacing calibration plate 245 with another calibration plate having a different thickness. Alternatively, calibration of shear rod 204 may be accomplished by placing shims behind calibration plate 245. In performing this calibration, bolts should never be allowed to protrude past the surface of calibration plate 245 as this configuration would interfere with shear rod 204.

FIG. 15 shows window locator 22 in its run-in position. As described above in connection with FIGS. 7 and 9, alternative running tool 12 in FIG. 15 may also contain recesses. The recesses may contain shear pins. Head 24 may also contain cooperating recesses. When first assembled for operation, the shear pins may hold head 24 in a stationary position in the same manner as described above. Apex 96 of head 24 may for example be at a 6⅝" cross-section. Rod 204 is held in place by mating engagement of shoulder 218*a* with dog 228 such that the expansion or biasing force of spring means 214 is unable to reciprocate end 252 of rod 204 external of shear bushing 210. The expansion or biasing force of spring means 222 has caused the reciprocation of spring loaded bushing 206 against dog assembly 208.

FIG. 16 shows window locator 22 after it has come into contact with ID of well bore 60 that is smaller than the OD of running tool 12 in its run-in position, e.g., 6⅝". For example, as shown in FIG. 16, running tool 12 and in particular head 24 of window locator 22 has come into contact with the smaller well bore ID 60 and been compressed to a cross-section of 6¼". Lower section 230 of dog assembly 208 contacts and engages floor 232 of running tool 12 while head 24 continues to compress within tool 12. This causes dog 228 to disengage from first shoulder 218*a*. Rod 204 is now able, via the expansion force of spring means 214, to advance to a position where end 252 of rod 204 extends external of shear bushing 210 and contacts surface 244 of block 202. For example, rod 204 may advance by ⅜".

Figure 17:
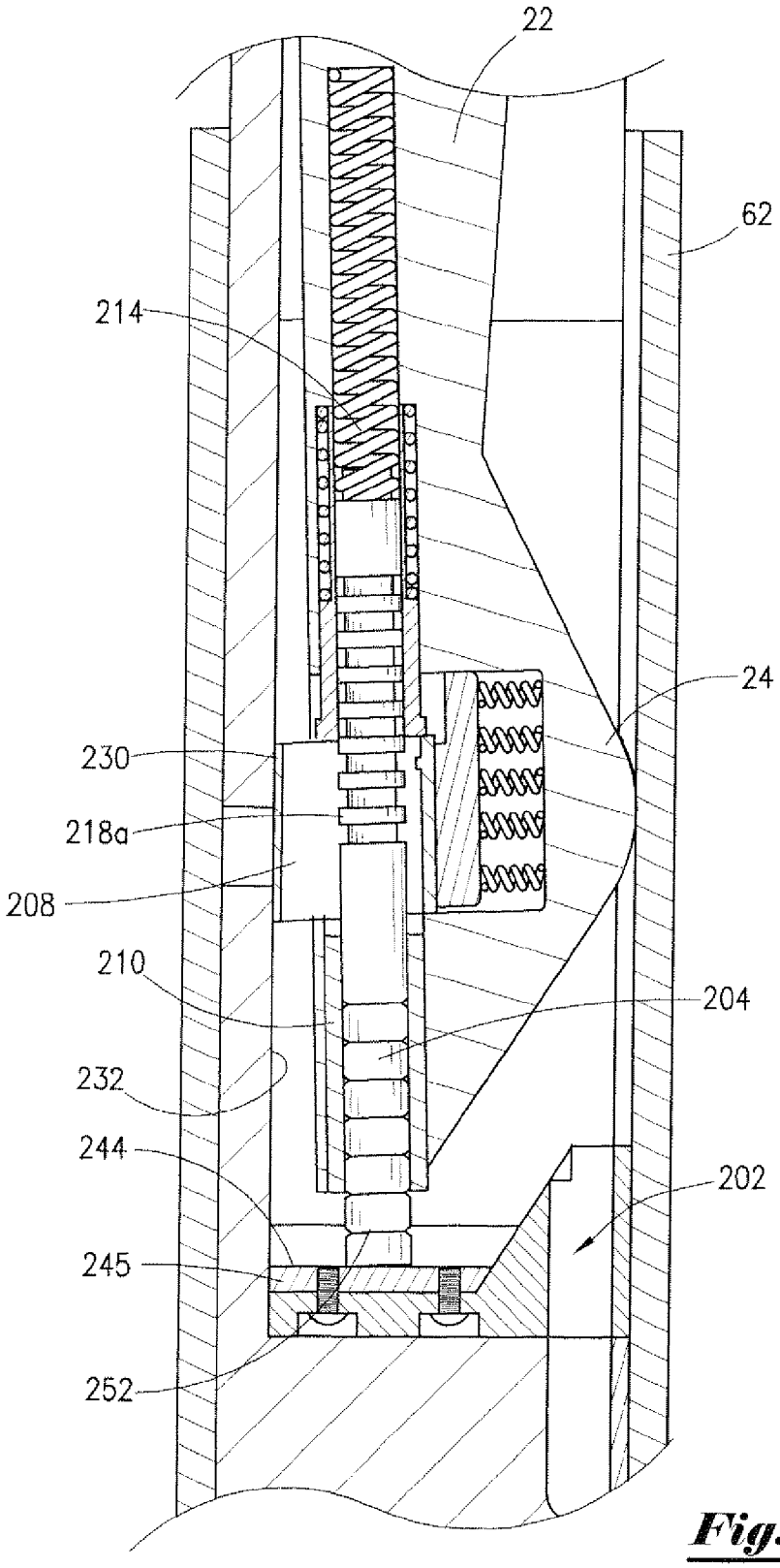
FIG. 17 is a partial cross-sectional side view of the alternative running tool component shown in FIG. 16 with the head of the window locator compressed to a second position.

FIG. 17 shows window locator 22 after it has entered casing 62. Head 24 has been further compressed, for example, to a 6¼" cross-section.

Figure 18:
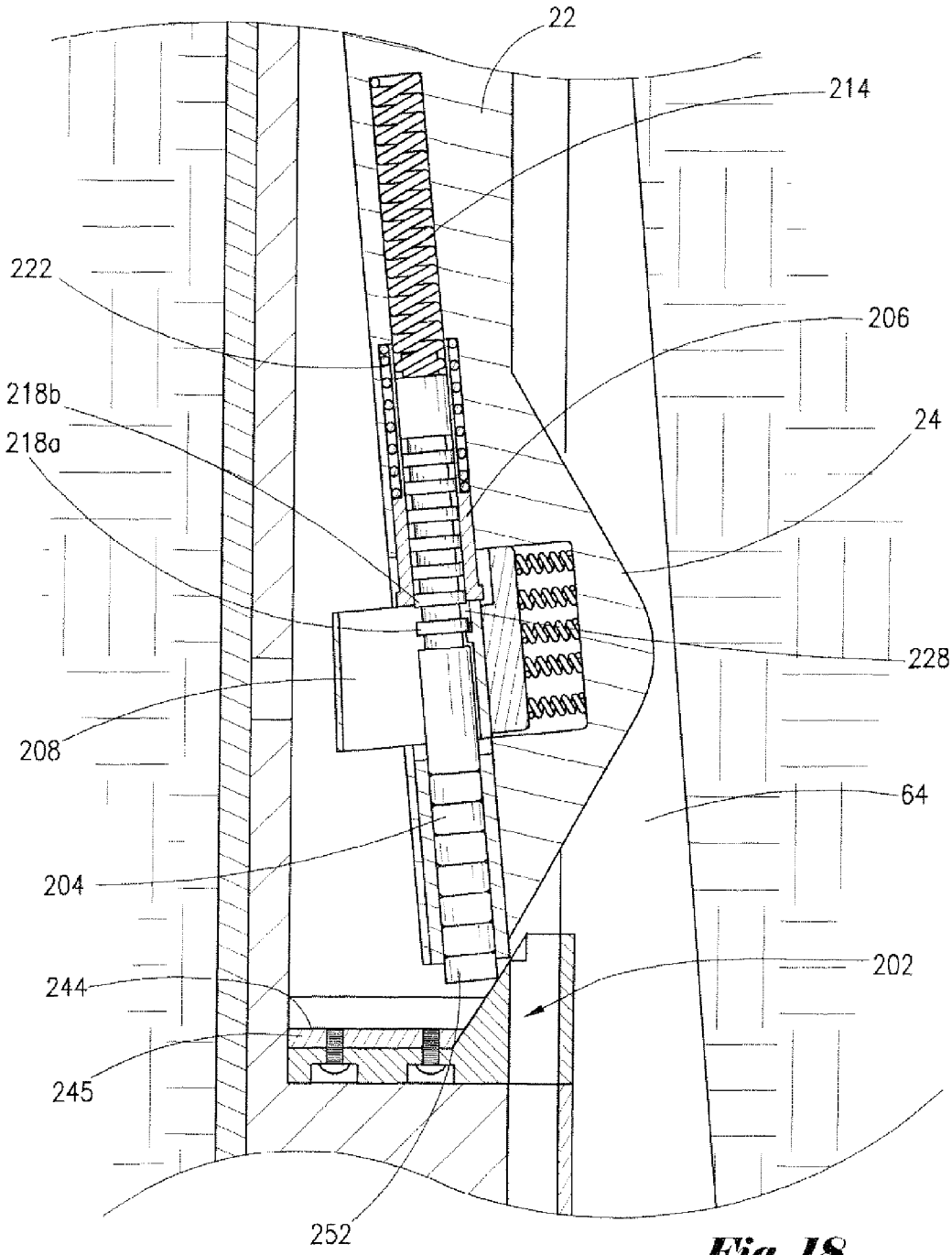
FIG. 18 is a partial cross-sectional side view of the alternative running tool component shown in FIG. 17 with the head of the window locator compressed to third position.

FIG. 18 shows window locator 22 after head 24 has located window 64. Head 24 is moving into window 64. End 252 of rod 204 has traveled up surface 244 of block 202. Rod 204 has reengaged dog assembly 208 but dog 228 is now positioned between shoulders 218*a* and 218*b*. As end 252 travels along tapered surface 246, rod 204 retracts back into window locator 22 via engagement of dog 228 and shoulder 218*b*, retraction of dog assembly 208 and spring loaded bushing 206 and compression of spring means 222. Dog assembly 208 may retract, for example, by ⅛".

Figure 19:
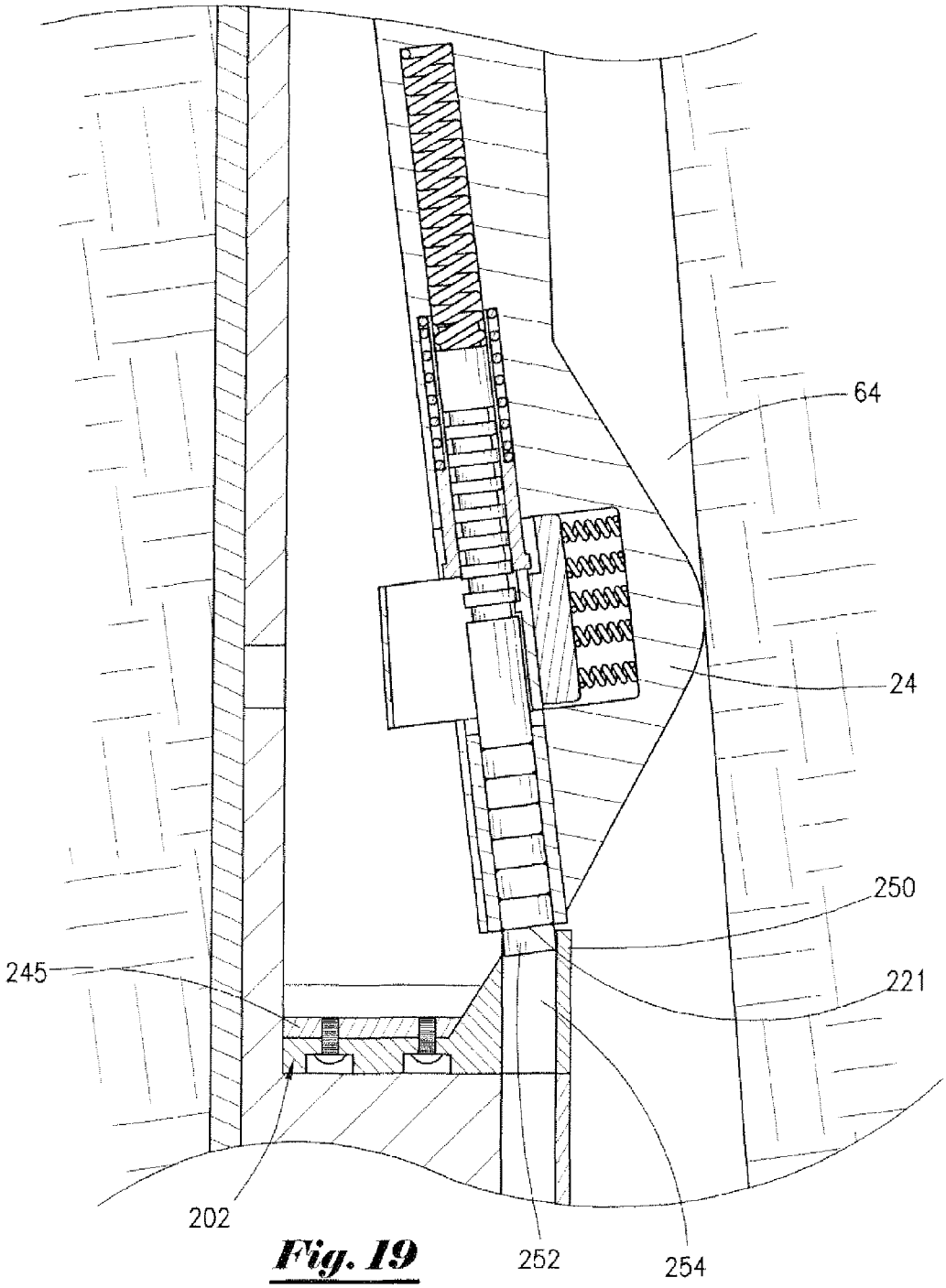
FIG. 19 is a partial cross-sectional side view of the alternative running tool component shown in FIG. 18 with the head of the window locator expanded to a window locating position.

FIG. 19 illustrates head 24 in fully extended position within window 64. End 252 of rod 204 has again extended and is positioned within recess 254 of block 202. The extension of head 24 has been stopped by stop shoulder 250 of block 202.

Figure 20:
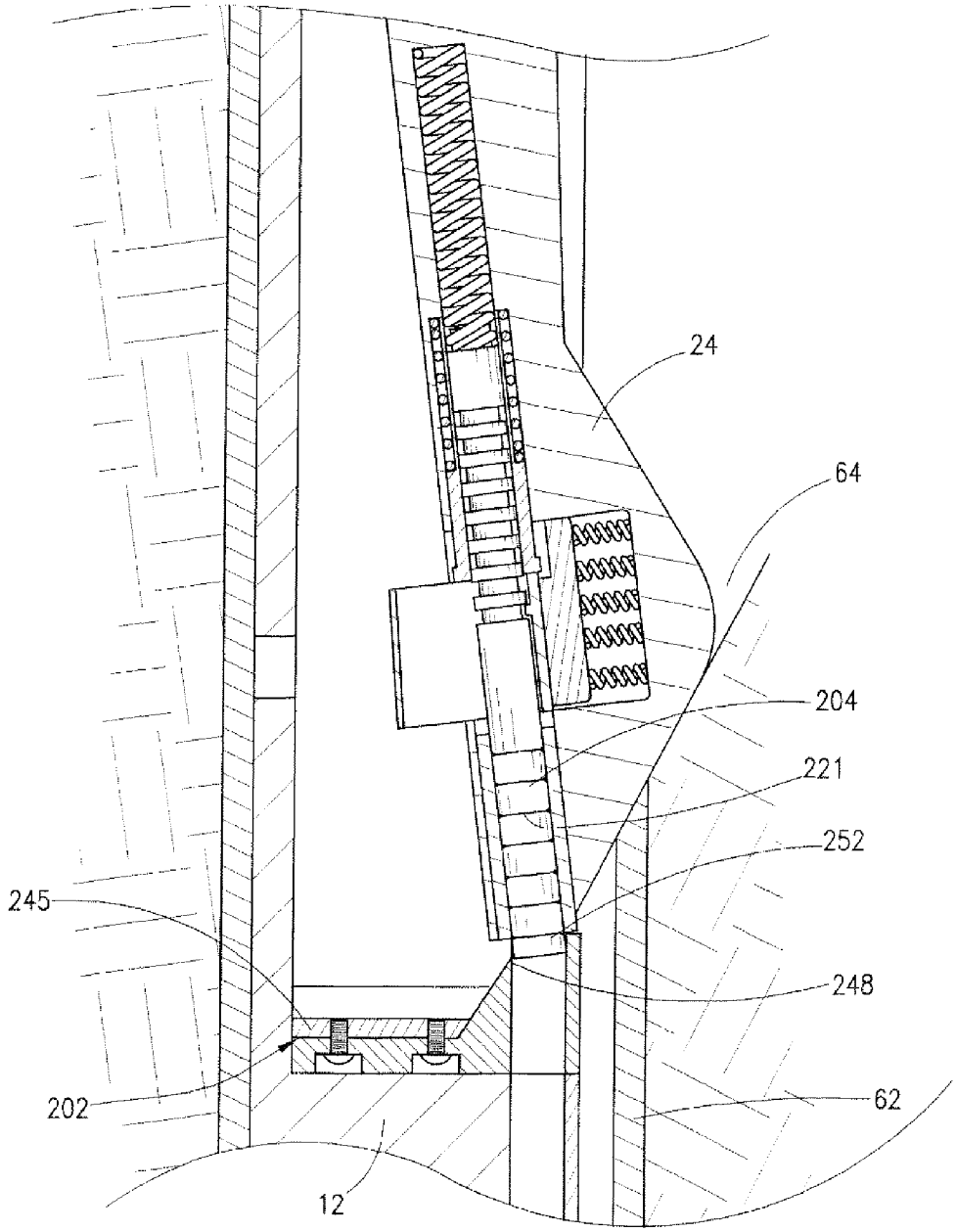
FIG. 20 is a partial cross-sectional side view of the alternative running tool component shown in FIG. 19 with the head of the window locator fully extended and locating a boundary of a first window.

FIG. 20 shows head 24 having reached either the top or bottom of window 64. Head 24 is compressed due to the narrowing of casing 62. End 252 of rod 204 contacts shear surface 248 of block 202 at first shear groove 221. The operator is able to determine, by the push or pull force of the tubular string to which assembly 10 is connected, the boundaries of window 64. The operator can also relocate window locator 22 upward or downward within casing 62 to locate a second window 64. As running tool 12 is run back into the narrower casing 62, head 24 compresses with such force to cause end 252 of rod 204 to shear at first shear groove 221. With the shearing of end 252, head 24 is able to further compress within running tool 12 to the position shown in FIG. 17. The process repeats as head 24 is brought into position with a second window 64. The process may be repeated multiple times to locate additional windows 64 or to relocate windows 64 within casing 62. For example, seven windows 64 may be located with assembly 10 and rod 204 may be sheared at each of shear grooves 221.

Figure 21:
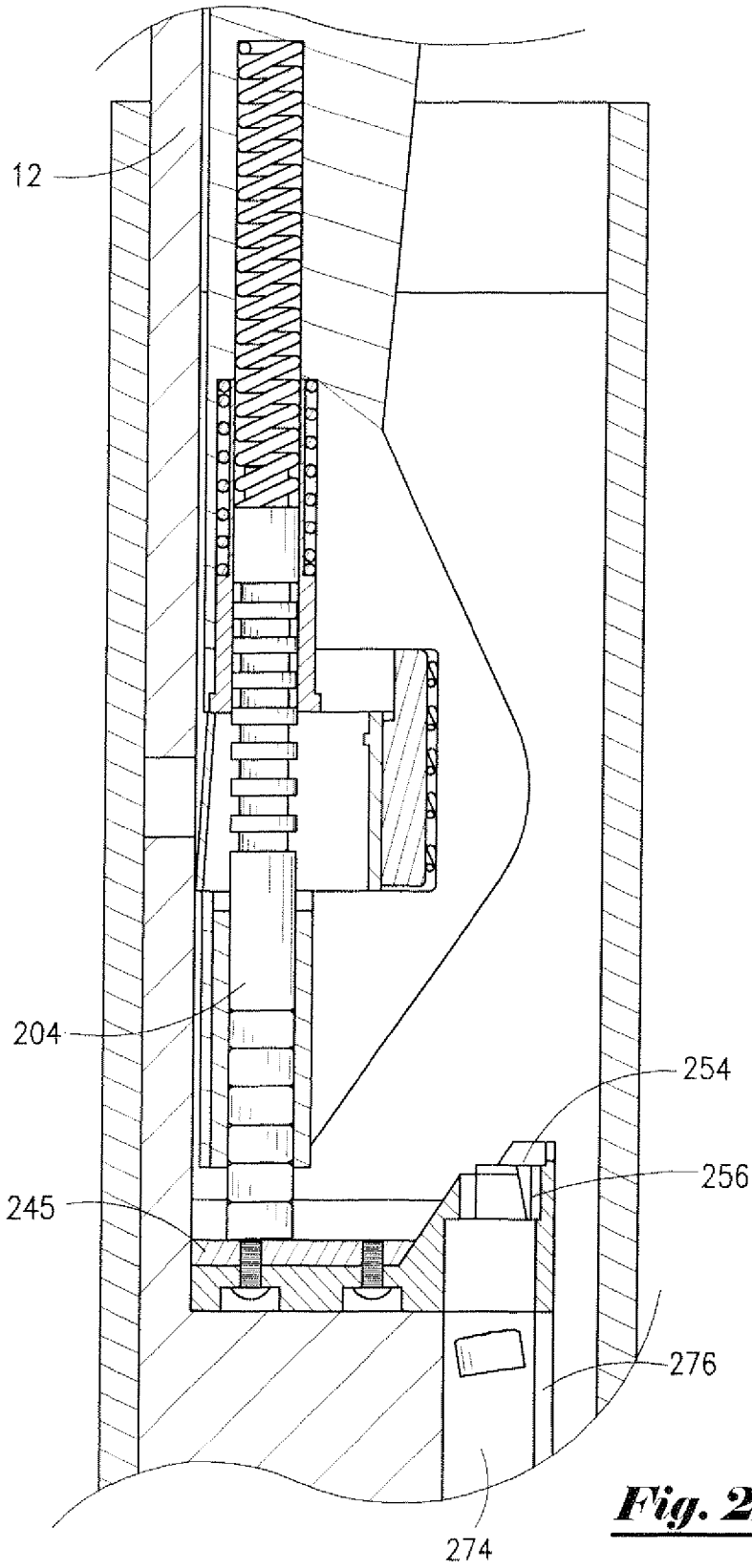
FIG. 21 is a partial cross-sectional side view of the alternative running tool component of the present invention showing the shear/stop block.
Figure 22:
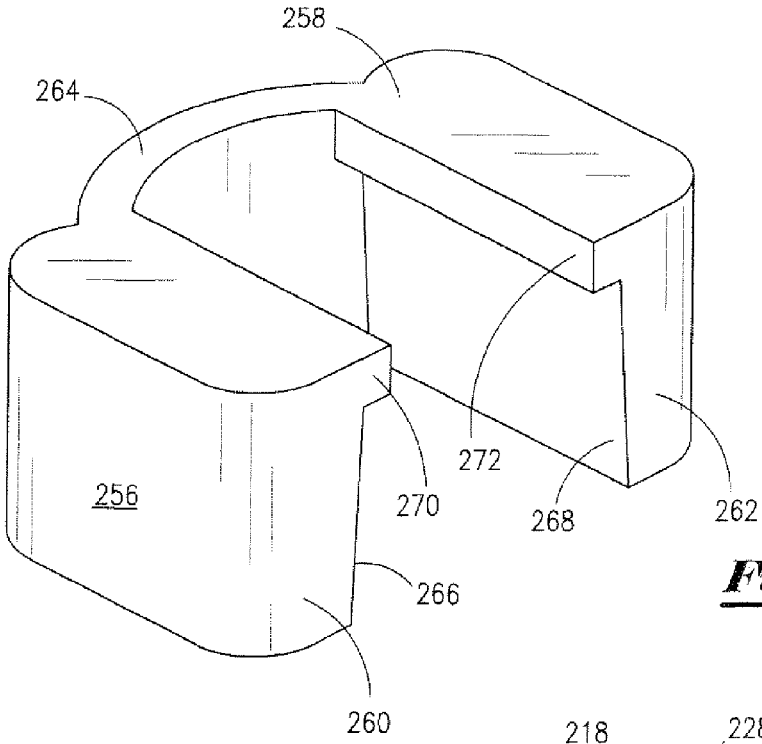
FIG. 22 is a perspective view of the catcher component of the alternative running tool of the present invention.

As seen in FIGS. 21 and 22, running tool 12 includes catcher 256. Catcher 256 is positioned in recess 254 such that front surface 258 of catcher 256 faces shear rod 204. Catcher 256 receives end 252 of rod 204. Catcher 256 also traps the sheared-off piece of rod 204. Catcher 256 may be any shape, including a U-shape as shown. Catcher 256 may have arms 260 and 262 and interconnecting top portion 264. Arms 260 and 262 each contain V-shaped surfaces 266 and 268 extending from front extensions 270 and 272. Catcher 256 or preferably arms 260, 262 may be made of a plastic or pliable material. Arms 260, 262 radially expand as end 252 of rod 204 is positioned in recess 254 as previously described to thereby grip and hold end 252 within catcher 256. After end 252 is sheared, the sheared end is pushed into pocket 274 of running tool 12. Pocket 274 is formed in running tool 12 and covered by plate 276. The new end 252 of rod 204 will be gripped by catcher 256 and when sheared will be retained in pocket 274. Pocket 274 is capable of storing multiple sheared ends. V-shaped surfaces 266, 268 allow the sheared ends to travel in one direction only. In other words, V-shaped surfaces 266, 268 of catcher 256 prevent stored sheared ends from leaving pocket 274.

Figure 24:
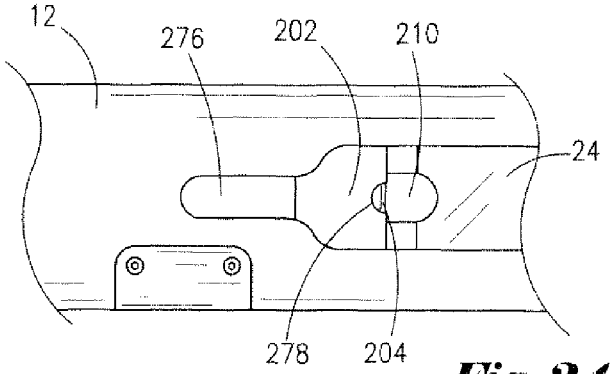
FIG. 24 is a side view of the alternative running tool of the present invention showing the inspection window in the shear/stop block.

Referring to FIG. 24, block 202 includes inspection window 278 for viewing the positioning of shear bushing 210 in relation to shear rod 204 when end 252 of shear rod 204 is positioned in recess 254 of block 202. When alternative running tool 12 is first assembled for operation, the front surface of shear busing 210 should be aligned with the first shear groove 221. This alignment is accomplished by viewing shear bushing 210 and shear rod 204 through inspection window 278 and making appropriate adjustments to the placement of shear bushing 210.

While preferred embodiments of the present invention have been described, it is to be understood that the embodiments described are illustrative only and that the scope of the invention is to be defined solely by the appended claims when accorded a full range of equivalents, many variations and modifications naturally occurring to those skilled in the art from a perusal hereof.

What is claimed is:

1. A down-hole assembly for locating a plurality of lateral well bore windows in a main well bore, comprising:

a running tool having an upper section, a middle section, a lower section and an internal cavity section with a cavity floor, said running tool including a window locator assembly for locating said plurality of lateral well bore windows, said window locator assembly pivotally positioned within said cavity of said running tool and including a window locator and a stop/shear block, said window locator including a selectively reciprocating shear rod operatively associated with said stop/shear block, said shear rod having a proximal end, a distal end, and an outer surface including a plurality of shoulders, said stop/shear block including a shear rod engaging surface, a tapered surface, a shear surface, and a stop shoulder;

a guide member having an upper section, a middle section and a lower section, said guide member having a wedged-shaped outer surface for diverting a down-hole tool through one of said plurality of lateral well bores and into a lateral well bore;

wherein said lower section of said running tool and said upper section of said guide member are each shaped to receive the other in mating relationship; and wherein said lower section of said running tool and said upper section of said guide member are capable of being detachably connected, and when detachably connected, said running tool and said guide member are in fluid communication.

2. The down-hole assembly according to claim 1, wherein said window locator further includes a first spring means operatively connected to said shear rod, said spring means biasing said shear rod in a direction towards said stop/shear block.

3. The down-hole assembly according to claim 2, wherein said first spring means is operatively connected to said proximal end of said shear rod.

4. The down-hole assembly according to claim 3, wherein said window locator further includes a spring-loaded bushing surrounding a first portion of said shear rod, said spring-loaded bushing including a second spring means.

5. The down-hole assembly according to claim 4, wherein said window locator further includes a dog assembly having an upper section, a lower section and an internal section containing a dog, said lower section positioned external of said window locator, said internal section operatively associated with a second portion of said shear rod, said dog selectively engaging one of said shoulders of said shear rod to prevent said shear rod from being reciprocated in said direction of said stop/shear block by said first spring means.

6. The down-hole assembly according to claim 5, wherein said dog assembly is movably positioned within a recess in said window locator.

7. The down-hole assembly according to claim 6, wherein said second spring means of said spring-loaded bushing biases said spring-loaded bushing into operative engagement with said dog assembly.

8. The down-hole assembly according to claim 7, wherein said window locator further includes a floating plate and a plurality of spring means, said floating plate and said plurality of spring means each contained within said recess of said window locator, said plurality of spring means biasing said floating plate into operative engagement with said upper section of said dog assembly.

9. The down-hole assembly according to claim 8, wherein said window locator further includes a shear bushing surrounding a third portion of said shear rod, said shear bushing positioned adjacent to said stop/shear block.

10. The down-hole assembly according to claim 9, wherein said shear rod engaging surface of said stop/shear block includes an adjustable calibration plate, said calibration plate capable of calibrating the point at which said dog selectively engages one of said shoulders of said shear rod.

11. The down-hole assembly according to claim 10, wherein said running tool further includes a calibration hole directly over said dog, said calibration hole capable of allowing a user to view the point at which said dog selectively engages one of said shoulders of said shear rod.

12. The down-hole assembly according to claim 9, wherein said stop/shear block includes a U-shaped catcher for receiving said shear rod and retaining a sheared piece of said shear rod, said catcher positioned between said stop shoulder and said shear surface of said stop/shear block.

13. The down-hole assembly according to claim 12, wherein said catcher includes a V-shaped surface capable of allowing said sheared piece of said shear rod to travel in only one direction.

14. The down-hole assembly according to claim 13, wherein said running tool further includes a pocket operatively connected to said stop/shear block for storing said sheared piece of said shear rod.

15. The down-hole assembly according to claim 14, wherein said outer surface of said shear rod also includes a plurality of shear grooves.

16. The down-hole assembly according to claim 15, wherein said stop/shear block further includes an inspection window for viewing the alignment of said shear bushing with said plurality of shear grooves on the surface of said shear rod.

17. A down-hole assembly for locating a plurality of lateral well bore windows in a main well bore, comprising:

a running tool having an upper section, a middle section, a lower section, and an internal cavity section with a cavity floor, said running tool including a window locator assembly for locating said plurality of lateral well bore windows, said window locator assembly pivotally positioned within said cavity of said running tool and including a window locator and a stop/shear block, said window locator comprising a pivoting arm, a window locating head, and a selectively reciprocating shear rod operatively associated with said stop/shear block, said shear rod having a proximal end, a distal end, and an outer surface including a plurality of shoulders, said stop/shear block including a shear rod engaging surface, a tapered surface, a shear surface, and a stop shoulder, said running tool further including a biasing means operatively associated with said window locator, said biasing means exerting a force on said pivoting arm of said window locator to bias said window locator head in a direction external of said running tool;

a guide member having an upper section, a middle section, and a lower section, said guide member having a wedge-shaped outer surface for diverting a down-hole tool through one of said plurality of lateral well bore windows and into a lateral well bore;

wherein said lower section of said running tool and said upper section of said guide member are each shaped to receive the other in mating relationship; and wherein said lower section of said running tool and said upper section of said guide member are capable of being detachably connected, and when detachably connected, said running tool and said guide member are in fluid communication.

18. The down-hole assembly according to claim 17, wherein said window locator further includes:

a first spring means operatively connected to said shear rod, said spring means biasing said shear rod in a direction towards said stop/shear block;

a spring-loaded bushing surrounding a first portion of said shear rod, said spring-loaded bushing including a second spring means;

a recess in said window locating heads;

a dog assembly movably positioned within said recess of said window locating head, said dog assembly having an upper section, a lower section, and an internal section containing a dog, said lower section positioned external of said window locator, said internal section operatively associated with a second portion of said shear rod, said dog selectively engaging a shoulder of said shear rod to prevent said shear rod from being reciprocated in said direction of said stop/shear block by said first spring means;

a floating plate and a plurality of spring means, said floating plate and said plurality of spring means each contained within said recess of said window locating head, said plurality of spring means biasing said floating plate into operative engagement with said upper section of said dog assembly; and a shear bushing surrounding a third portion of said shear rod, said shear bushing positioned adjacent to said stop/shear block.

19. The down-hole assembly according to claim 18, wherein said first spring means is operatively connected to said proximal end of said shear rod.

20. The down-hole assembly according to claim 19, wherein said second spring means of said spring-loaded bushing biases said spring-loaded bushing into operative engagement with said dog assembly.

21. The down-hole assembly according to claim 20, wherein said shear rod engaging surface of said stop/shear block includes an adjustable calibration plate, said calibration plate capable of calibrating the point at which said dog selectively engages a shoulder of said shear rod.

22. The down-hole assembly according to claim 21, wherein said running tool further includes a calibration hole directly over said dog, said calibration hole capable of allowing a user to view the point at which said dog selectively engages a shoulder of said shear rod.

23. The down-hole assembly according to claim 16, wherein said stop/shear block further includes a catcher for receiving said shear rod and retaining a sheared piece of said shear rod, said catcher positioned between said stop shoulder and said shear surface of said stop/shear block.

24. The down-hole assembly according to claim 23, wherein said catcher includes a V-shaped surface capable of allowing said sheared piece of said shear rod to travel in only one direction.

25. The down-hole assembly according to claim 24, wherein said running tool further includes a pocket for storing said sheared piece of said shear rod, said pocket operatively connected to said stop/shear block for passage of said sheared piece from said catcher to said pocket.

26. The down-hole assembly according to claim 25, wherein said outer surface of said shear rod also includes a plurality of shear grooves.

27. The down-hole assembly according to claim 26, wherein said stop/shear block further includes an inspection window for viewing the alignment of said shear bushing with said plurality of shear grooves on the surface of said shear rod.

28. A method of locating a plurality of lateral well bore windows in a main well bore, comprising the steps of:

(a) deploying a tubular down said main well bore, said tubular containing a down-hole assembly, said down-hole assembly including a running tool having an upper section, a middle section, a lower section, and an internal cavity section with a cavity floor, said running tool including a window locator assembly for locating said plurality of lateral well bore windows, said window locator assembly pivotally positioned within said cavity of said running tool and including a window locator and a stop/shear block, said window locator including a pivoting arm, a window locating head, and a selectively reciprocating shear rod operatively associated with said stop/shear block, said shear rod having a proximal end, a first distal end, and an outer surface including a plurality of shoulders, said stop/shear block including a shear rod engaging surface, a tapered surface, a shear surface, and a stop shoulder; a guide member having an upper section, a middle section, and a lower section, said guide member having a wedge-shaped outer surface for diverting a down-hole tool through one of said plurality of lateral well bore windows and into a lateral well bore; wherein said lower section of said running tool and said upper section of said guide member are each shaped to receive the other in mating relationship; wherein said lower section of said running tool and said upper section of said guide member are capable of being detachably connected, and when detachably connected, said running tool and said guide member are in fluid communication; and wherein as deployed, said reciprocating shear rod is maintained in a non-reciprocating position so that said first distal end of said shear rod does not engage said shear rod engaging surface of said stop/shear block;

(b) running said down-hole assembly to a first area in said main well bore having a first internal diameter that causes said window locating head to move inward relative to said cavity of said running tool releasing said shear rod from said non-reciprocating position to a reciprocating position wherein said first distal end of said shear rod engages said shear rod engaging surface of said stop/shear block;

(c) running said down-hole assembly to a second area in said main well bore having a second internal diameter that causes said window locating head to move further inward relative to said cavity of said running tool;

(d) running said down-hole assembly to a first lateral well window in said main well bore that causes said window locating head to move outward relative to said cavity of said running tool to a first window locating position wherein said first distal end of said shear rod upwardly traverses said shear rod engaging surface of said stop/shear block, said tapered surface of said stop/shear block, and engages said stop shoulder;

(e) determining an upper edge or a lower edge of said first lateral well bore window;

(f) positioning said down-hole assembly to a third area in said main well bore having a third internal diameter that causes said window locating head to move inward relative to said cavity of said running tool wherein said first distal end of said shear rod is sheared by said shear surface of said stop/shear block resulting in a second distal end of said shear rod, said second distal end of said shear rod downwardly traversing said tapered surface of said stop/shear block and said shear rod engaging surface of said stop/shear block;

(g) running said down-hole assembly to a second lateral well bore window in said main well bore that causes said window locating head to move outward relative to said cavity of said running tool to a second window locating position wherein said second distal end of the shear rod upwardly traverses said shear rod engaging surface of said stop/shear block, said tapered surface of said stop/shear block, and engages said stop shoulder;

(h) determining an upper edge or a lower edge of said second lateral well bore window.

29. The method according to claim 28, wherein said stop/shear block includes a catcher for receiving said distal end of said shear rod and retaining a sheared first distal end of said shear rod, the method further including the step of:

(i) retaining said sheared first distal end of said shear rod in said catcher.

30. The method according to claim 29, further comprising the step of:

(j) repeating steps (f) through (h) one to five additional times to locate a third, a fourth, a fifth, a sixth, or a seventh lateral well bore window in said main well bore.

31. The method according to claim 30, wherein said running tool includes a pocket for storing said sheared first distal end of said shear rod, the method further including the step of:

(k) causing said sheared first distal end of said shear rod retained by said catcher to be deposited in said pocket for storage.

32. The method according to claim 31, wherein said outer surface of said stop/shear block also includes a plurality of shear grooves, and wherein said first distal end of said shear rod is sheared at one of said plurality of shear grooves by said shear surface of said stop/shear block.

33. The method according to claim 32, wherein said catcher includes a V-shaped surface capable of allowing said sheared first distal end of said shear rod to travel in only one direction.

34. The method according to claim 32, further comprising a calibration step before step (a), wherein said shear rod engaging surface includes an adjustable calibration plate, and wherein said running tool further includes a calibration hole disposed over said plurality of shoulders on said shear rod, said calibration step comprising:

(1) calibrating said reciprocating position of said shear rod by replacing said calibration plate with a second calibration plate having a different diameter than said calibration plate or by inserting one or more shims behind said calibration plate;

(2) observing through said calibration hole the position of said shoulders in said reciprocating position; and (3) repeating step (1) as necessary to achieve the desired reciprocating position.

35. The method according to claim 34, further comprising an alignment step before step (a), wherein said stop/shear block further includes an inspection window, said alignment step comprising, and wherein said window locator further includes a shear bushing surrounding a portion of said outer surface of said shear rod:

(1) observing through said inspection window the position of said shear bushing in relation to said first distal end and one of said plurality of shear grooves on said shear rod; and (2) aligning said shear bushing with said one of said plurality of shear grooves by adjusting the position of said shear bushing.

36. The method according to claim 28, further comprising the steps of:

(i) positioning said guide member adjacent to one of said first or second lateral well bore windows;

(j) anchoring said guide member in said main well bore;

(k) detaching said running tool from said guide member;

(l) pulling said running tool out of said main well bore; and (m) deploying a second tubular containing said down-hole tool down said main well bore, through said one of said first or second lateral well bore windows, and into said lateral well bore, said wedge-shaped outer surface of said guide member acting to divert said down-hole tool from said main well bore, through said one of said first or second lateral well bore windows, and into said lateral well bore.

37. The method according to claim 36, further comprising the step of:

(n) causing said down-hole tool to perform remedial work on said lateral well bore.

38. The method according to claim 37, further comprising the steps of:

(o) deploying a third tubular containing a fishing tool down said main well bore;

(p) connecting said fishing tool to said guide member;

(q) disengaging said guide member from said main well bore; and (r) pulling said guide member out of said main well bore.

39. The method according to claim 28, wherein said main well bore is a cased well bore.

40. The method according to claim 28, wherein said tubular is a work string, drill pipe, or coiled tubing.

41. The method according to claim 40, wherein said tubular is a coiled tubing and wherein said down-hole assembly further comprises an indexing tool.

* * * * *